US010802437B2

(12) United States Patent
Oi et al.

(10) Patent No.: US 10,802,437 B2
(45) Date of Patent: Oct. 13, 2020

(54) STATIC ELIMINATING DEVICE AND IMAGE FORMING APPARATUS

(71) Applicant: KYOCERA Document Solutions Inc., Osaka (JP)

(72) Inventors: Hironobu Oi, Osaka (JP); Teruhiko Nagashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/276,458

(22) Filed: Feb. 14, 2019

(65) Prior Publication Data

US 2019/0179234 A1 Jun. 13, 2019

Related U.S. Application Data

(62) Division of application No. 15/483,029, filed on Apr. 10, 2017, now Pat. No. 10,248,044.

(30) Foreign Application Priority Data

Apr. 27, 2016 (JP) ..... 2016-088972
Apr. 27, 2016 (JP) ..... 2016-088973

(51) Int. Cl.
*G03G 21/08* (2006.01)
*G03G 21/06* (2006.01)
(Continued)

(52) U.S. Cl.
CPC ..... *G03G 21/08* (2013.01); *G03G 21/06* (2013.01); *G03G 21/1647* (2013.01); *G03G 15/04* (2013.01); *G03G 21/1666* (2013.01)

(58) Field of Classification Search
CPC ..... G03G 21/08; G03G 21/1647
See application file for complete search history.

(56) References Cited

U.S. PATENT DOCUMENTS 6,678,491 B2 * 1/2004 Kido ..... G03G 21/08 399/113
8,660,464 B2 2/2014 Ishino et al.
(Continued)

FOREIGN PATENT DOCUMENTS

CN 101216690 A 7/2008
CN 102221807 A 10/2011
(Continued)

OTHER PUBLICATIONS

An Office Action mailed by the Japanese Patent Office dated Oct. 23, 2018, which corresponds to Japanese Patent Application No. 2016-088972 and is related to U.S. Appl. No. 15/483,029.
(Continued)

*Primary Examiner* — Arlene Heredia
(74) *Attorney, Agent, or Firm* — Studebaker & Brackett PC

(57) ABSTRACT

A static eliminating device includes a light guide body formed in a bar shape and attached to a drum frame, and a light source. The light source is arranged at one end side in a longitudinal direction of the light guide body. The light guide body includes a plurality of reflection parts and an attachment part. The plurality of reflection parts is arranged in parallel in the longitudinal direction within a range at the other end side from a start position spaced a predetermined distance from one end in the longitudinal direction. The attachment part is arranged between one end in the longitudinal direction and the start position to act as a start point of thermal deformation in the longitudinal direction. The attachment part is composed of two protrusions to interpose an edge of a positioning hole provided in the drum frame at one end side in the longitudinal direction.

4 Claims, 24 Drawing Sheets

(51) Int. Cl.
*G03G 21/16* (2006.01)
*G03G 15/04* (2006.01)

(56) References Cited

U.S. PATENT DOCUMENTS

| | | | | |
|---|---|---|---|---|
| 9,063,513 | B2 * | 6/2015 | Kobayashi | G03G 21/1666 |
| 9,207,623 | B2 | 12/2015 | Kamiyama | |
| 2008/0159783 | A1 | 7/2008 | Jung et al. | |
| 2011/0249987 | A1 | 10/2011 | Ishino et al. | |
| 2013/0136499 | A1 | 5/2013 | Kamiyama | |
| 2014/0161480 | A1 * | 6/2014 | Hanano | G03G 21/08 399/92 |

FOREIGN PATENT DOCUMENTS

| | | | |
|---|---|---|---|
| JP | S62-167244 | U | 10/1987 |
| JP | 2002-278395 | A | 9/2002 |
| JP | 2003-295717 | A | 10/2003 |
| JP | 2011-221405 | A | 11/2011 |
| JP | 2013-033091 | A | 2/2013 |
| JP | 2013113901 | A | 6/2013 |

OTHER PUBLICATIONS

An Office Action mailed by the Japanese Patent Office dated Nov. 27, 2018, which corresponds to Japanese Patent Application No. 2016-088973 and is related to U.S. Appl. No. 15/483,029; with English translation.

An Office Action issued by the State Intellectual Property Office of the People's Republic of China dated Mar. 24, 2020, which corresponds to Chinese Patent Application No. 201710208842.X and is related to U.S. Appl. No. 16/276,458 with English language translation.

* cited by examiner

STATIC ELIMINATING DEVICE AND IMAGE FORMING APPARATUS

INCORPORATION BY REFERENCE

This application is a Divisional of U.S. patent application Ser. No. 15/483,029 filed Apr. 10, 2017, and is based on and claims the benefit of priority from Japanese Patent application No. 2016-088972 filed on Apr. 27, 2016, and Japanese Patent application No. 2016-088973 filed on Apr. 27, 2016, the entire contents of which are incorporated herein by reference.

BACKGROUND

The present disclosure relates to a static eliminating device electrically discharging a photosensitive drum and an image forming apparatus including a plurality of photosensitive drums along a transfer belt.

An image forming apparatus of an electrographic manner may include a plurality of photosensitive drums along a transfer belt. A surface of each photosensitive drum is electrically charged and exposed according to image data, and thereby, an electrostatic latent image is formed. Moreover, the electrostatic latent image is developed by adhering each color toner, and thereby, each color toner image is formed. The color toner images respectively formed on the photosensitive drum are primarily transferred onto a transfer belt, and thereby, a full color toner image is formed. Further, the full color toner image is secondarily transferred onto a sheet.

In the image forming apparatus, at the time of primarily transferring, difference in inflow of transfer current between a toner adhesion portion and a toner non-adhesion portion of the photosensitive drum occurs and influences electrically charging performance of the photosensitive drum, and thereby, image failure due to a transfer memory may occur. If the transfer current is lowered, inflow of the transfer current to the photosensitive drum may be restrained, but it is feared that transfer failure occurs.

Thereupon, for example, the image forming apparatus includes a static eliminating light source (a static eliminating device) located between primarily transferring and cleaning with respect to the photosensitive drum to irradiate the photosensitive drum with static eliminating light, and thereby, to electrically discharge (to perform so-called post-transfer static elimination) the photosensitive drum. The static eliminating light source also may irradiate an adjacent photosensitive drum arranged at a downstream side in a rotational direction of an intermediate transfer belt with the static eliminating light to electrically discharge (to perform so-called pre-transfer static elimination) the adjacent photosensitive drum. Thereby, because electric potential of the photosensitive drum before primarily transferring is lowered, if transfer current is lowered, occurrence of image failure due to the transfer memory may prevented without causing transfer failure. Moreover, because one static eliminating light source is commonly used for the post-transfer static elimination and the pre-transfer static elimination of two adjacent photosensitive drums, it is not necessary to provide new static eliminating light source and cost reduction is actualized.

However, the above-mentioned static eliminating light source is composed of LED arrays having LEDs as a light source arranged along an axial direction of the photosensitive drum. Therefore, in order to bring both functions of the post-transfer static elimination and the pre-transfer static elimination, there are problems that respective specific LEDs directed to respective directions for the post-transfer static elimination and the pre-transfer static elimination are required and the number of LEDs is increased.

By contrast, for example, the image forming apparatus may apply a side-light type static eliminating system using a static eliminating part (a static eliminating device) having one LED (a light source) and a light guide body to bring both functions of the post-transfer static elimination and the pre-transfer static elimination. This light guide body includes a first reflecting part and a second reflecting part (two reflecting faces) along the axial direction of the photosensitive drum.

In the image forming apparatus, surface electric potential difference (e.g. surface electric potential difference between an exposed area and a non-exposed area) is often caused in the photosensitive drum before electrical charging step, and then, there is a problem that image failure, such as so-called drum ghost, occurs due to this surface electric potential difference. In order to restrain such image failure, the image forming apparatus may include a static eliminating device irradiating a surface of the photosensitive drum with static eliminating light before electrical charging step to electrically discharge surface electric potential of the photosensitive drum to a predetermined residual electric potential level. The static eliminating device may be configured to convert light from a light source to linearly spreading light by a light guide body and to expose the photosensitive drum.

For example, in the image forming apparatus, the static eliminating device is composed of a light guide at a process cartridge including the photosensitive drum and the light source at an apparatus body. The light guide is composed of a lens and an exterior case. In the lens, a plurality of V-formed grooves (prisms) are provided. The groove is formed at an angle of 5-15 degrees with respect to a radial direction of the lens.

As mentioned above, in the static eliminating device including the one light source and the light guide body, it is necessary to restrain non-uniformity of light quantity in the axial direction of the photosensitive drum between the static eliminating light for actualizing the pre-transfer static elimination and the static eliminating light for actualizing the post-transfer static elimination outputted from the light guide body. In order to restrain non-uniformity of light quantity of the static eliminating lights, it is required to greatly heighten accuracy of a shape of the reflecting face of the light guide body. The reflecting face of the light guide body is formed so as to arrange the plurality of prisms (grooves) along the axial direction. An emission angle of light emitted by reflection of the prism (light emitted from an emission face side) and an emission angle of light emitted from a back face of the prism by transmission through the prism without reflection are different from each other. Therefore, in the light guide body including the one reflecting face, because it is difficult to uniform light quantities of pre-transfer static eliminating light and post-transfer static eliminating light in the axial direction, the above-mentioned static eliminating device includes two reflecting faces in the light guide body. However, because a cost of metal mold for forming the two reflecting faces elongated in the axial direction becomes very expensive, a cost as a product unit price is increased.

Incidentally, with respect to the pre-transfer static eliminating light, if the light quantity is too small, sufficient effect preventing image failure of transfer memory cannot be obtained, and if the light quantity is too large, character scattering may occur to bring image degradation. Moreover, with respect to the post-transfer static eliminating light, if the light quantity is too small, static eliminating function is insufficient, and if the light quantity is too large, carriers due to exposing expensively may occur to bring occurrence of image failure of transfer memory. Therefore, it is necessary to uniform light both pre-transfer static eliminating light quantity and post-transfer static eliminating light quantity within a desired range over the whole area of in the axial direction, but it is very difficult to actualize desired pre-transfer static eliminating light quantity and pre-transfer static eliminating light quantity over the whole area of in the axial direction, particularly in the light guide body including the one reflecting face.

The light guide body of the static eliminating device as mentioned above needs to include an attachment shape for being attached to a drum unit or the like provided with the photosensitive drum. However, in the light guide body, because light may be leaked from a portion where this attachment shape is formed, non-uniformity of light quantity in an axial direction of the light guide body (in the axial direction of the photosensitive drum) may occur due to light leak depending on a position where the attachment shape is formed.

Moreover, the attachment shape may function as positioning of the light guide body to the drum unit or the like. However, depending on its shape and a positioning way, the static eliminating light quantity may vary due to variation of a distance between the light source and the light guide body. Further, non-uniformity of light quantity in the axial direction of the light guide body (in the axial direction of the photosensitive drum) may occur due to thermal deformation, such as curvature, by thermal expansion and thermal contraction of the light guide body.

SUMMARY

In accordance with the present disclosure, an image forming apparatus includes an annular transfer belt rotating in a predetermined rotational direction, a plurality of photosensitive drums, a plurality of primary transferring parts, a plurality of static eliminating parts and a plurality of cleaning parts. The plurality of photosensitive drums are arranged along the rotational direction of the transfer belt. The plurality of primary transferring parts transfer images formed on the plurality of photosensitive drums to the transfer belt. The plurality of static eliminating parts discharge electric potential by irradiating the plurality of photosensitive drums with static eliminating light. The plurality of cleaning parts remove toner remained on the plurality of photosensitive drums. Each static eliminating part is arranged between each primary transferring part and each cleaning part, and includes a light guide body elongated in an axial direction of each photosensitive drum and a light source arranged at one end side in a longitudinal direction of the light guide body. Each static eliminating part is configured so as to irradiate an upstream side and a downstream side from the light guide body in the rotational direction of the transfer belt with the static eliminating light. The image forming apparatus further comprises at least any one of a first light shading part and a second light shading part. The first light shading part is arranged between the photosensitive drum at a downstream side from the light guide body in the rotational direction of the transfer belt and the light guide body to adjust pre-transfer static eliminating light quantity from the light guide body to the photosensitive drum at the downstream side. The second light shading part is arranged between the photosensitive drum at an upstream side from the light guide body in the rotational direction of the transfer belt and the light guide body to adjust post-transfer static eliminating light quantity from the light guide body to the photosensitive drum at the upstream side.

In accordance with the present disclosure, a static eliminating device includes a light guide body formed in a bar shape and a light source. The light source is arranged at one end side in a longitudinal direction of the light guide body. The light guide body includes a plurality of reflection parts and an attachment part. The plurality of reflection parts is arranged in parallel in the longitudinal direction within a range at the other end side from a start position spaced a predetermined distance from one end in the longitudinal direction. The attachment part is arranged between one end in the longitudinal direction and the start position to act as a start point of thermal deformation in the longitudinal direction.

In accordance with the present disclosure, an image forming apparatus includes the static eliminating device as described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
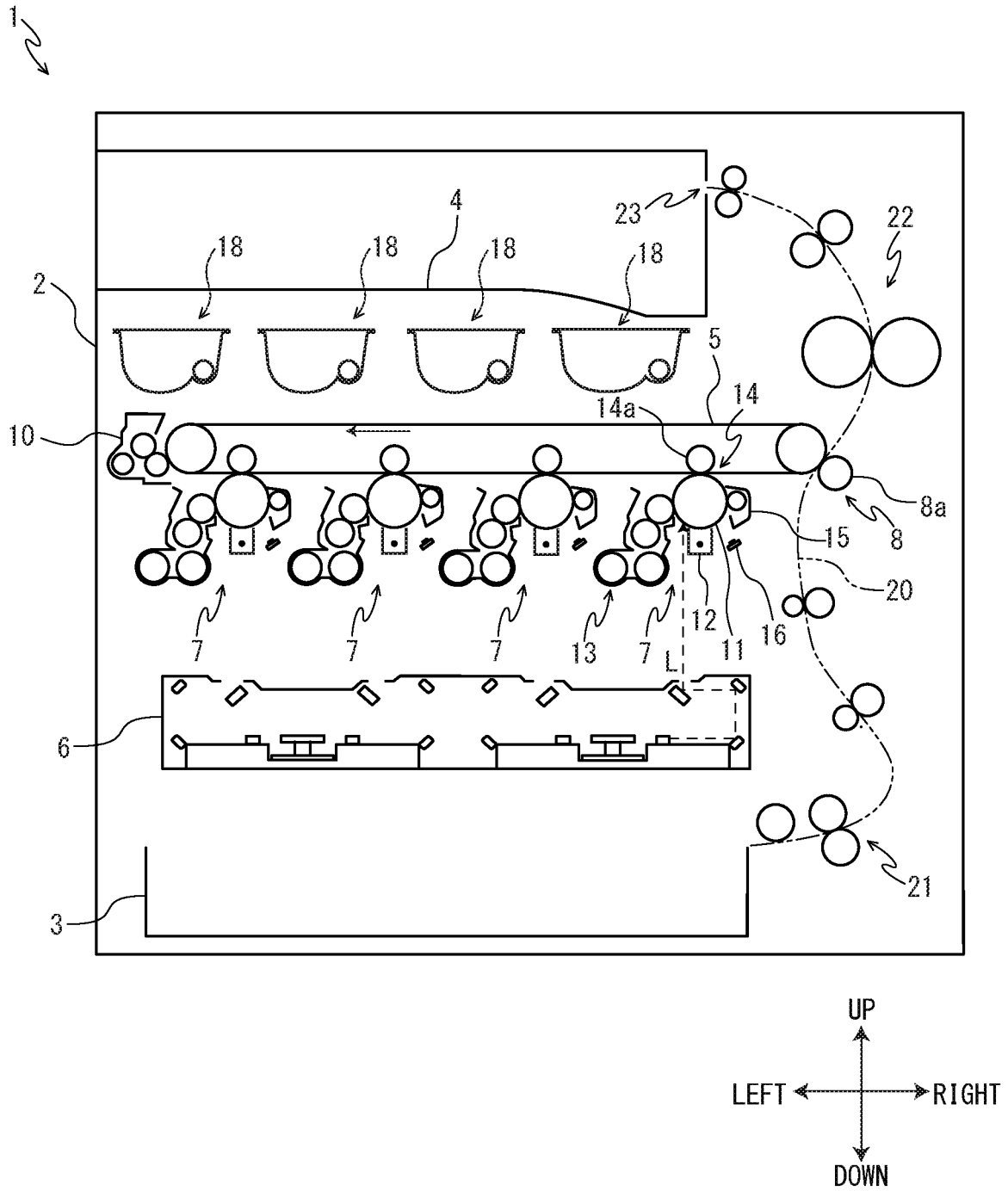
FIG. 1 is a sectional view showing a color printer according to an embodiment of the present disclosure.

First, an entire configuration of a color printer 1 (an image forming apparatus) according to an embodiment of the present disclosure will be described with reference to FIG. 1. Hereinafter, for convenience of description, it will be described so that the front side of the color printer is positioned at the near side on a paper sheet of FIG. 1.

The color printer 1 includes a roughly box-formed printer body 2. In a lower part of the printer body 2, a sheet feeding cartridge 3 storing sheets (recording mediums) is provided and, in an upper part of the printer body 2, an ejected sheet tray 4 is provided.

At a central part of the printer body 2, an annular intermediate transfer belt 5 (a transfer belt) rotating in a predetermined direction is windingly stretched among a plurality of rollers. Below the intermediate transfer belt 5, an exposing unit 6 composed of a laser scanning unit (LSU) is disposed. At the lower side of the intermediate transfer belt 5, four image forming parts 7 are provided for respective toner colors (for example, four colors of yellow, magenta, cyan and black). At a right end of the intermediate transfer belt 5, a secondary transferring part 8 is provided and, at a left end of the intermediate transfer belt 5, a cleaning unit 10 cleaning the intermediate transfer belt 5 is provided. The secondary transferring part 8 is composed of a part of a right end side of the intermediate transfer belt 5 and a secondary transferring roller 8*a*.

In each image forming part 7, a photosensitive drum 11 is rotatably provided. The photosensitive drum 11 is formed, for example, in a cylindrical shape elongated in forward and downward directions and the forward and downward directions are an axial direction of the photosensitive drum 11. Around the photosensitive drum 11, a charging device 12, a developing device 13 (a developing unit), a primary transferring part 14, a static eliminating device 15 (a static eliminating part) and a cleaning device 16 (a cleaning part) are disposed in sequential order of primary transferring processes. The photosensitive drum 11 is attached to a drum unit 17, and the charging device 12, the static eliminating device 15 and the cleaning device 16 are also attached to the drum unit 17. Above the developing device 13, the toner containers 18 corresponding to the respective image forming parts 7 are provided for respective toner colors (for example, four colors of yellow, magenta, cyan and black). The primary transferring part 14 is composed of a part of the intermediate transfer belt 5 and a primary transferring roller 14*a*. The primary transferring roller 14*a* is disposed to face to an upper side surface of the photosensitive drum 11 across the intermediate transfer belt 5. The static eliminating device 15 is composed of a light guide body 25 and a light source 26 and the light guide body 25 is covered by a light shading member 27.

At one side (the right side on the figure) of the printer body 2, a conveying path 20 for the sheet is provided in upward and downward directions. At an upstream end of the conveying path 20, a sheet feeding part 21 is provided. At a middle stream part of the conveying path 20, the above-described secondary transferring part 8 is provided. At a downstream part of the conveying path 20, a fixing device 22 is provided. At a downstream end of the conveying path 20, a sheet ejecting port 23 is provided.

Next, the operation of forming an image by the color printer 1 having such a configuration will be described. When the power is supplied to the color printer 1, various parameters are initialized and initial determination, such as temperature determination of the fixing device 22, is carried out. Subsequently, in the color printer 1, when image data is inputted and a printing start is directed from an external computer or the like connected to the color printer, image forming operation is carried out as follows.

Firstly, a surface of the photosensitive drum 11 is electrically charged by the charging device 12. Then, an electrostatic latent image is formed on the surface of the photosensitive drum 11 by a laser light (refer to an arrow L) from the exposing unit 6. The electrostatic latent image is developed to a toner image having a correspondent color in the developing device 13 by the toner supplied from the toner container 18. The toner image is primarily transferred onto the surface of the intermediate transfer belt 5 in the primary transferring part 14. The above-mentioned operation is repeated in order by the respective image forming parts 7, thereby forming the toner image having full color onto the intermediate transfer belt 5. Incidentally, toner and electric charge remained on the photosensitive drum 11 are removed by the static eliminating device 15 and the cleaning device 16.

On the other hand, the sheet taken out from the sheet feeding cartridge 3 or a manual bypass tray (not shown) by the sheet feeding part 21 is conveyed to the secondary transferring part 8 in a suitable timing for the above-mentioned image forming operation. Then, in the secondary transferring part 8, the toner image having full color on the intermediate transfer belt 5 is secondarily transferred onto the sheet. The sheet with the secondary transferred toner image is conveyed to a downstream side on the conveying path 20 to enter the fixing device 22, and then, the toner image is fixed on the sheet in the fixing device 22. The sheet with the fixed toner image is ejected from the sheet ejecting port 23 onto the ejected sheet tray 4.

Next, a configuration of the drum unit 17 of the embodiment will be described with reference to FIGS. 2-7.

Figure 6:
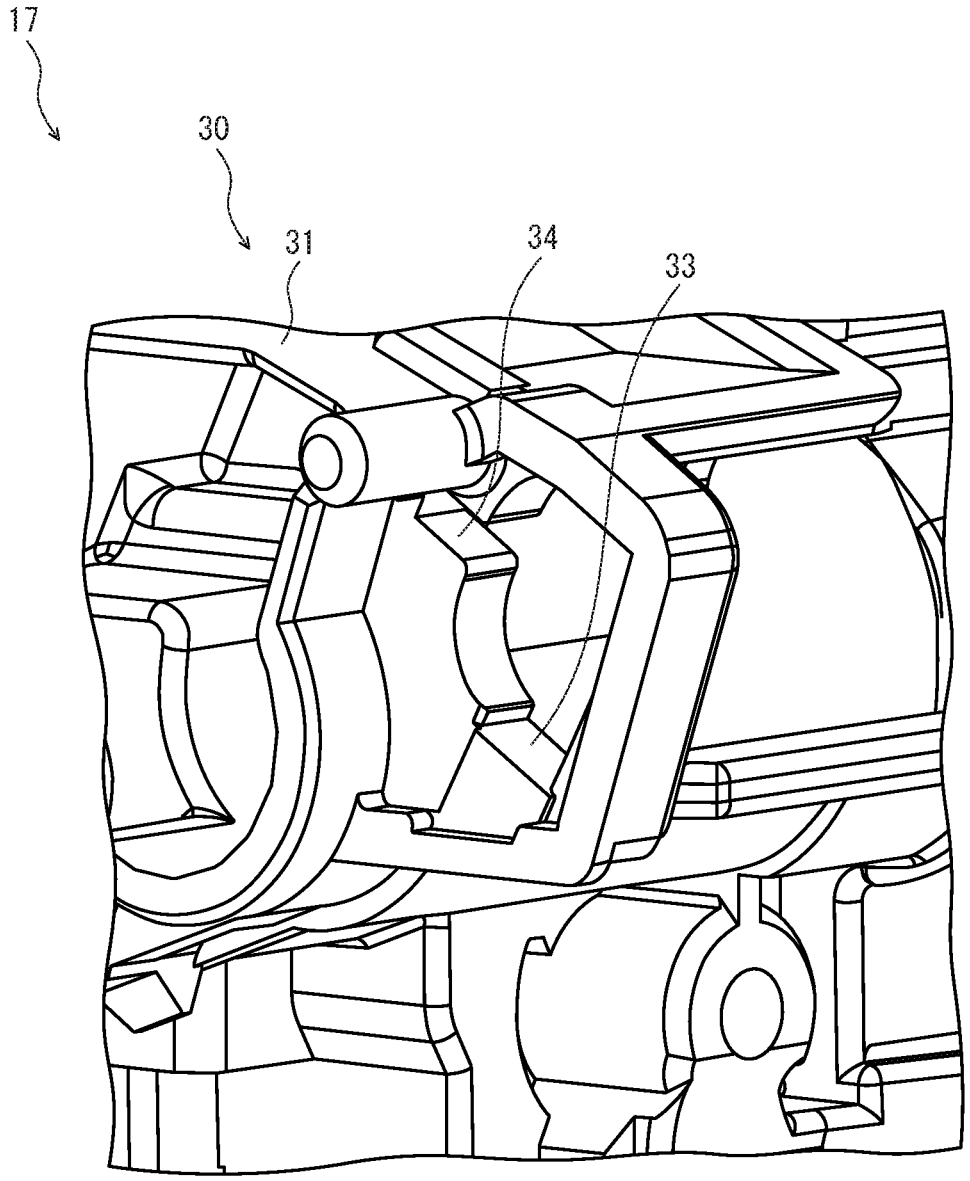
FIG. 6 is a perspective view showing a front part of a drum frame of the drum unit in the color printer according to the embodiment of the present disclosure.
Figure 7:
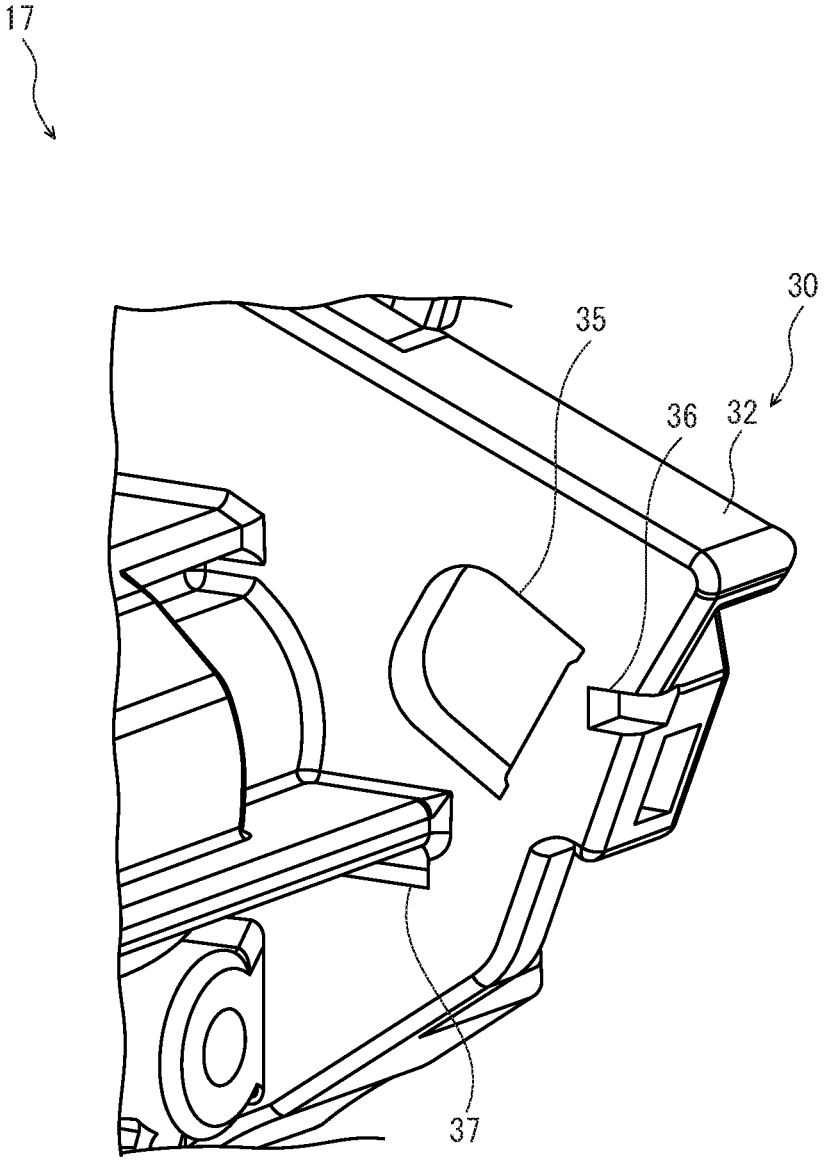
FIG. 7 is a perspective view showing a rear part of the drum frame of the drum unit in the color printer according to the embodiment of the present disclosure.

The drum unit 17 includes a drum frame 30 having at least a front plate part 31 and a rear plate part 32, and the drum frame 30 rotatably supports the photosensitive drum 11 between the front plate part 31 and the rear plate part 32. At the lower side of the drum frame 30, the charging device 12 electrically charging a lower side surface of the photosensitive drum 11 over the forward and backward directions is fixed. At the right side of the drum frame 30, the cleaning device 16 cleaning a right side surface of the photosensitive drum 11 over the forward and backward directions is fixed. Moreover, to the drum frame 30, at a right upper side from an attachment position of the cleaning device 16, the light guide body 25 of the static eliminating device 15 and the light shading member 27 are attached. For example, in the front plate part 31 of the drum frame 30, as shown in FIG. 6, a first front positioning hole 33 positioning a front part of the light guide body 25 and a second front positioning hole 34 positioning a front part of the light shading member 27 are provided. In the rear plate part 32 of the drum frame 30, as shown in FIG. 7, a first rear positioning hole 35 positioning a rear part of the light guide body 25 and second rear positioning holes 36 and 37 positioning a rear part of the light shading member 27 are provided.

Next, a configuration of the static eliminating device 15 of the embodiment will be described with reference to FIGS. 2-5, 8-13 and 17-23. Because the respective static eliminating devices 15 of the four image forming parts 7 have similar configurations, one static eliminating device 15 will be described hereinafter.

The static eliminating device 15 electrically discharges surface electric potential of the photosensitive drum 11 after primarily transferring by the primary transferring part 14 in the image forming part 7 including this static eliminating device 15 (i.e. performs post-transfer static elimination). Further, the static eliminating device 15 electrically discharges surface electric potential of the photosensitive drum 11 before primarily transferring by the primary transferring part 14 in the image forming part 7 at a downstream side from the image forming part 7 including this static eliminating device 15 in a rotational direction of the intermediate transfer belt 5 (i.e. performs post-transfer static elimination for the photosensitive drum 11 at the downstream side).

Figure 2:
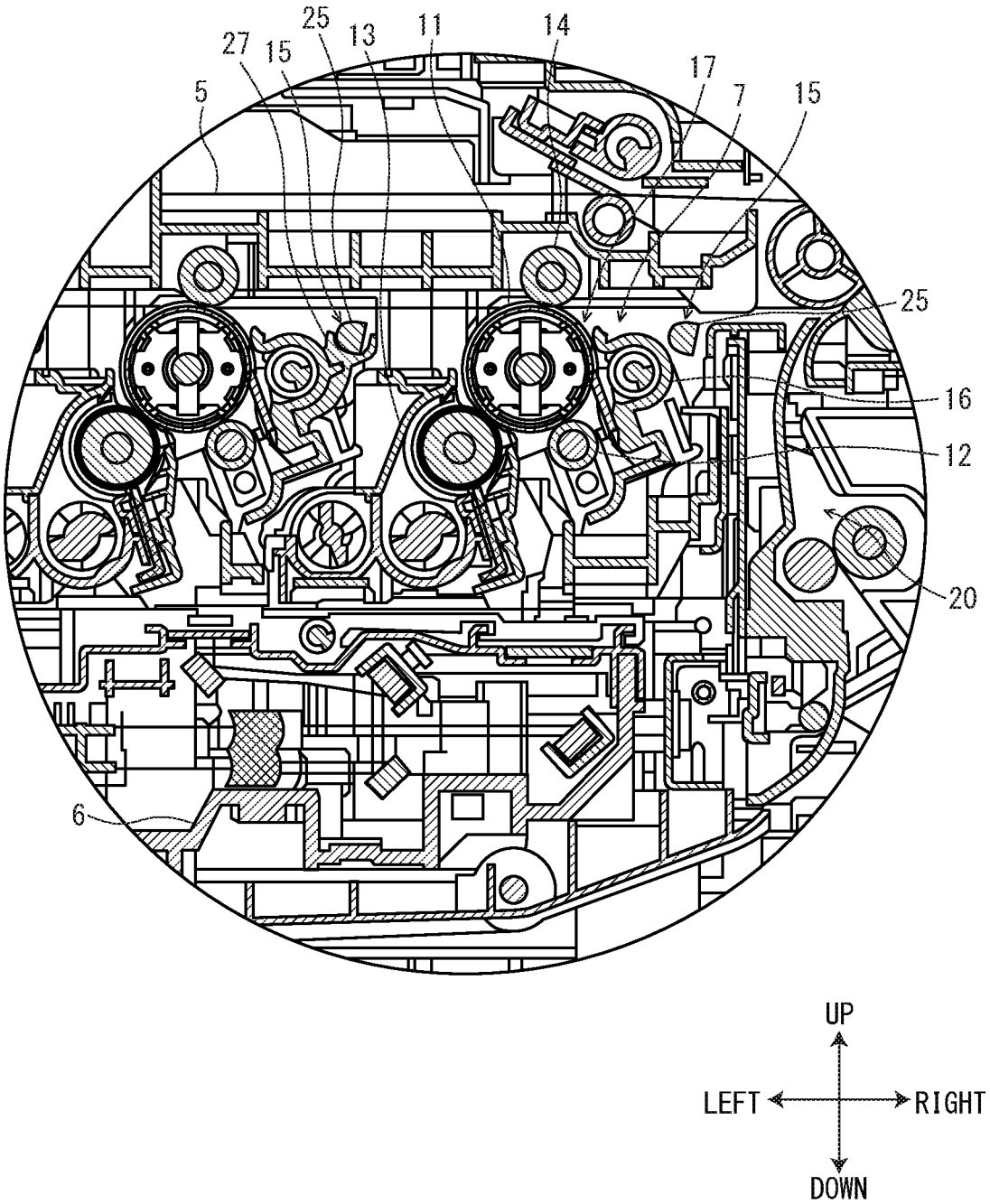
FIG. 2 is a sectional view showing an image forming part in the color printer according to the embodiment of the present disclosure.
Figure 3:
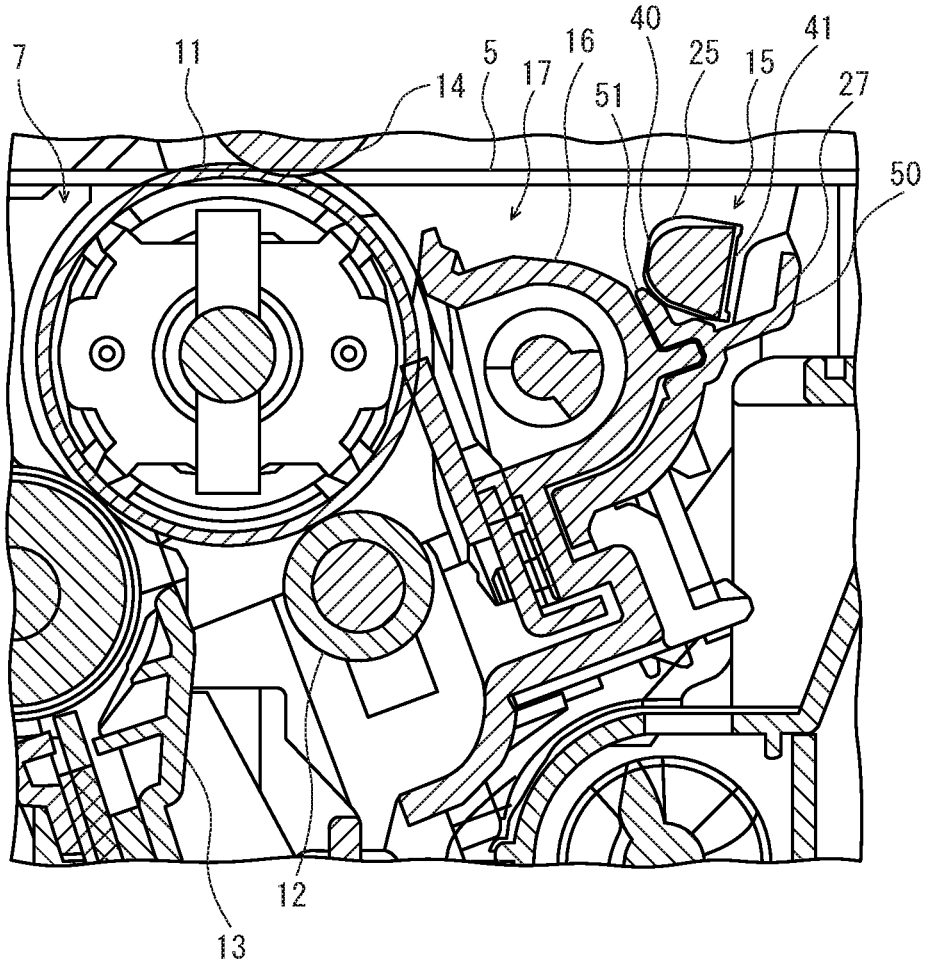
FIG. 3 is a sectional view showing a drum unit in the color printer according to the embodiment of the present disclosure.
Figure 4:
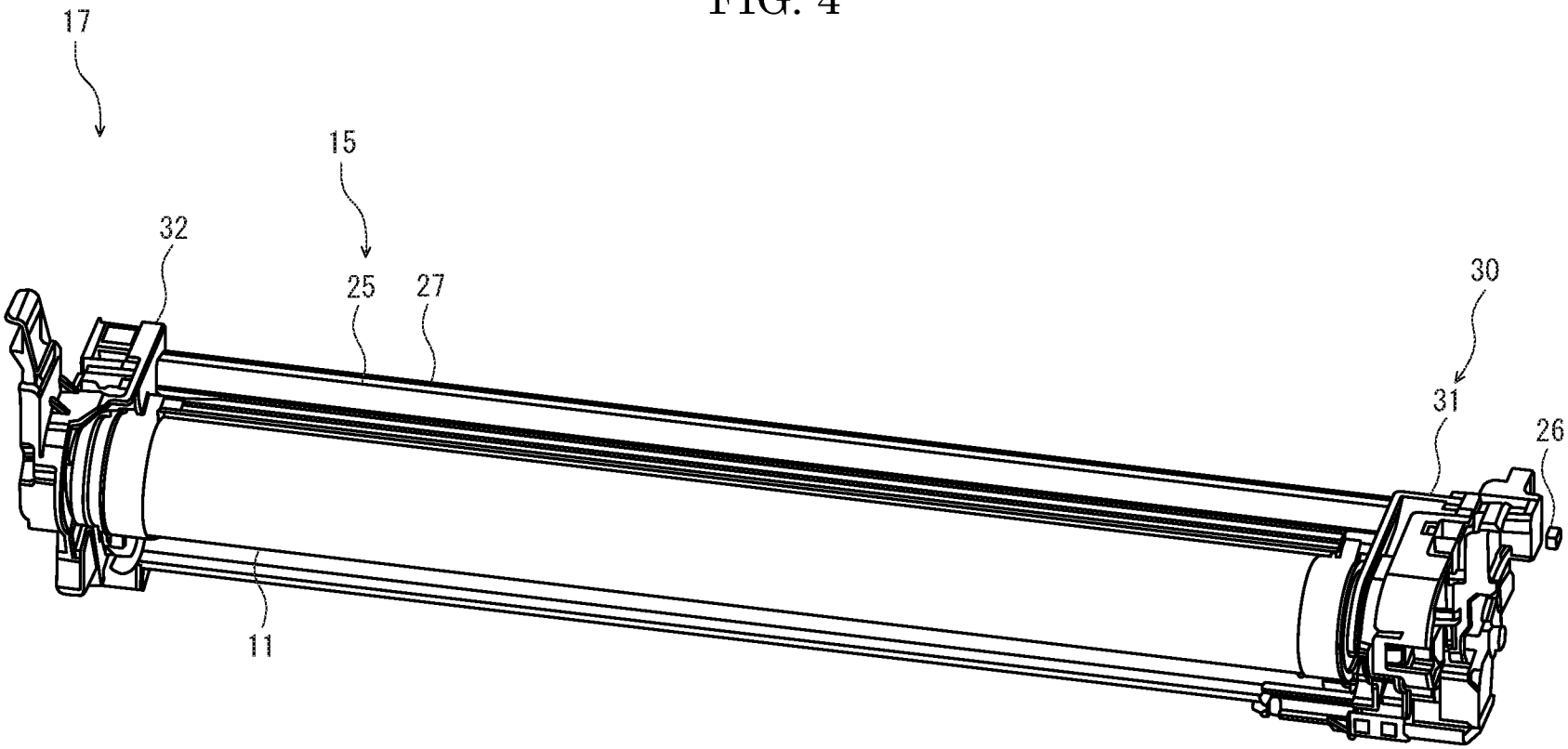
FIG. 4 is a perspective view showing the drum unit as viewed from the left side in the color printer according to the embodiment of the present disclosure.
Figure 5:
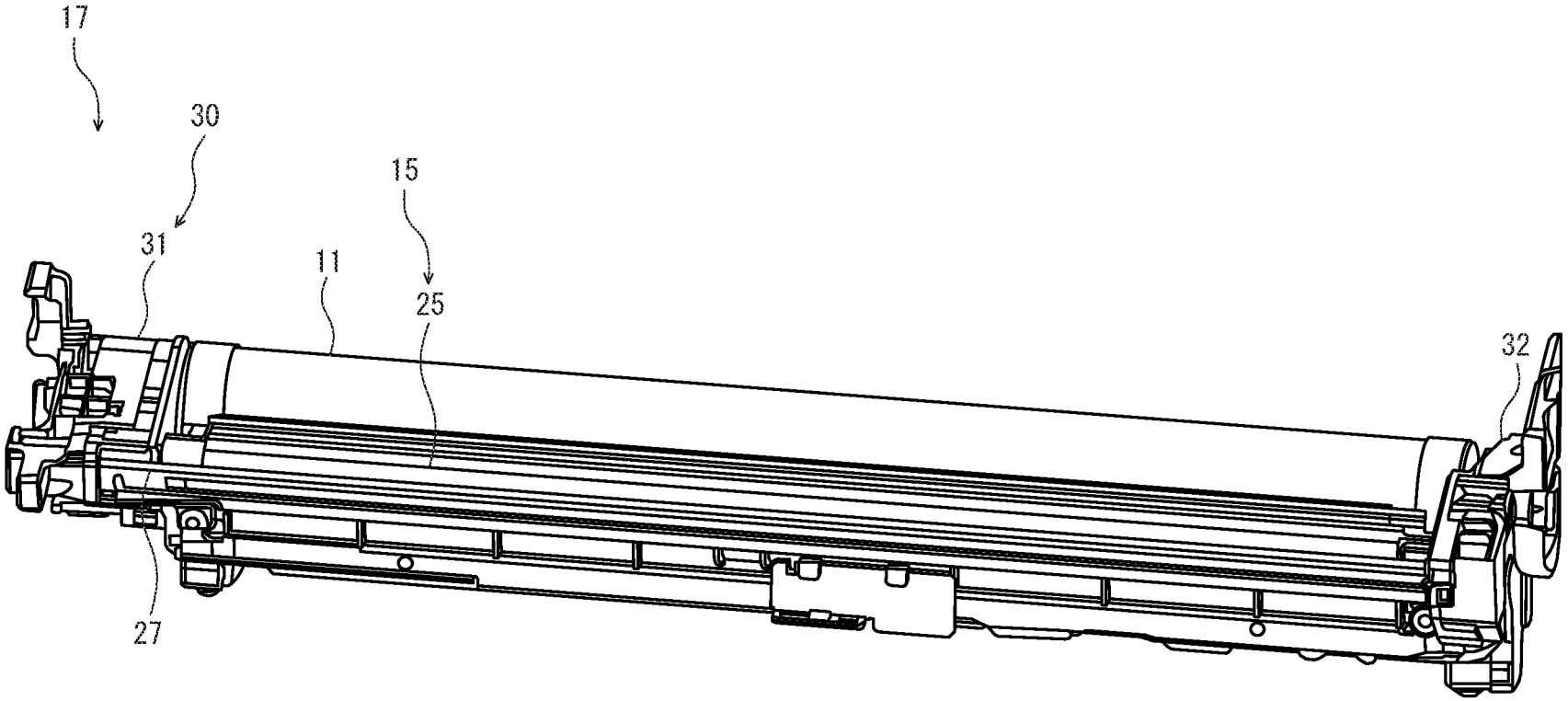
FIG. 5 is a perspective view showing the drum unit as viewed from the right side in the color printer according to the embodiment of the present disclosure.

The light guide body 25 of the static eliminating device 15 is formed in a bar shape elongated in the forward and backward directions and its length is longer than a length of the photosensitive drum 11 and a distance between the front plate part 31 and the rear plate part 32 of the drum frame 30. The light guide body 25 is arranged, as shown in FIGS. 2 and 3, to face to the photosensitive drum 11. Hereinafter, a face of the light guide body 25 facing to the photosensitive drum 11 is called as an emission face 40 and a face of the light guide body 25 opposite to the emission face 40 is called as a reflection face 41. In the embodiment, the light guide body 25 is arranged to face to a right upper surface of the photosensitive drum 11 while avoiding the cleaning device 16 and to direct the emission face 40 on the left side and the slightly upper side. Moreover, the light guide body 25 has a convex formed sectional shape curved at the emission face 40 side and the reflection face 41 is formed in a planar shape.

Figure 8:
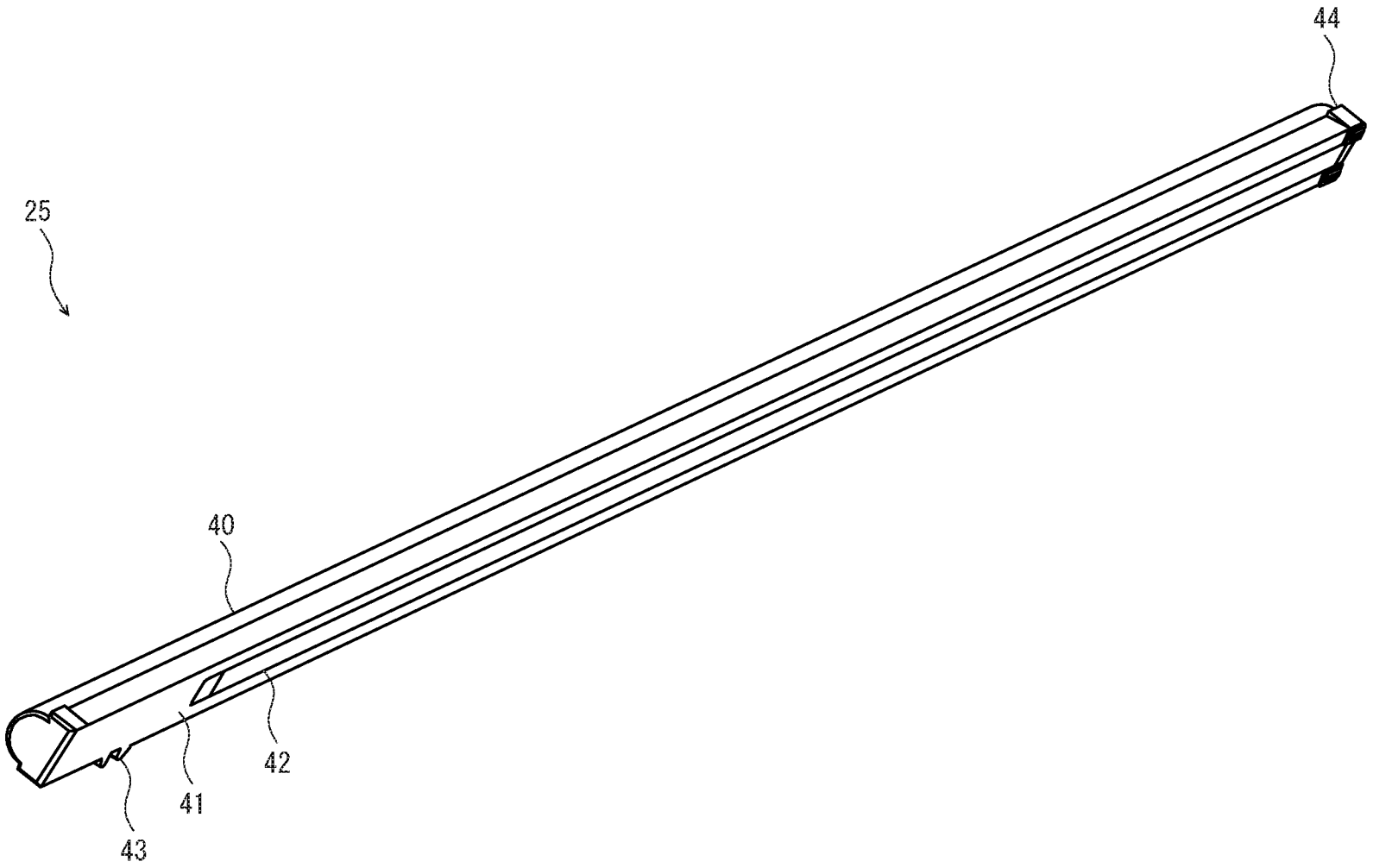
FIG. 8 is a perspective view showing a light guide body of a static eliminating device in the color printer according to the embodiment of the present disclosure.
Figure 9:
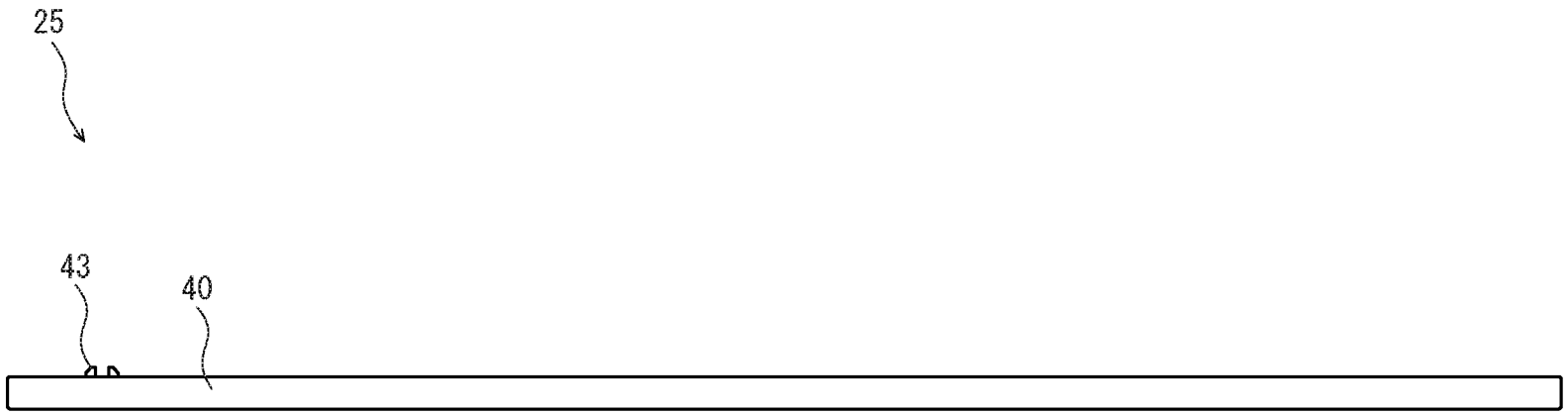
FIG. 9 is a side view showing the light guide body of the static eliminating device viewed from the left side in the color printer according to the embodiment of the present disclosure.
Figure 10:
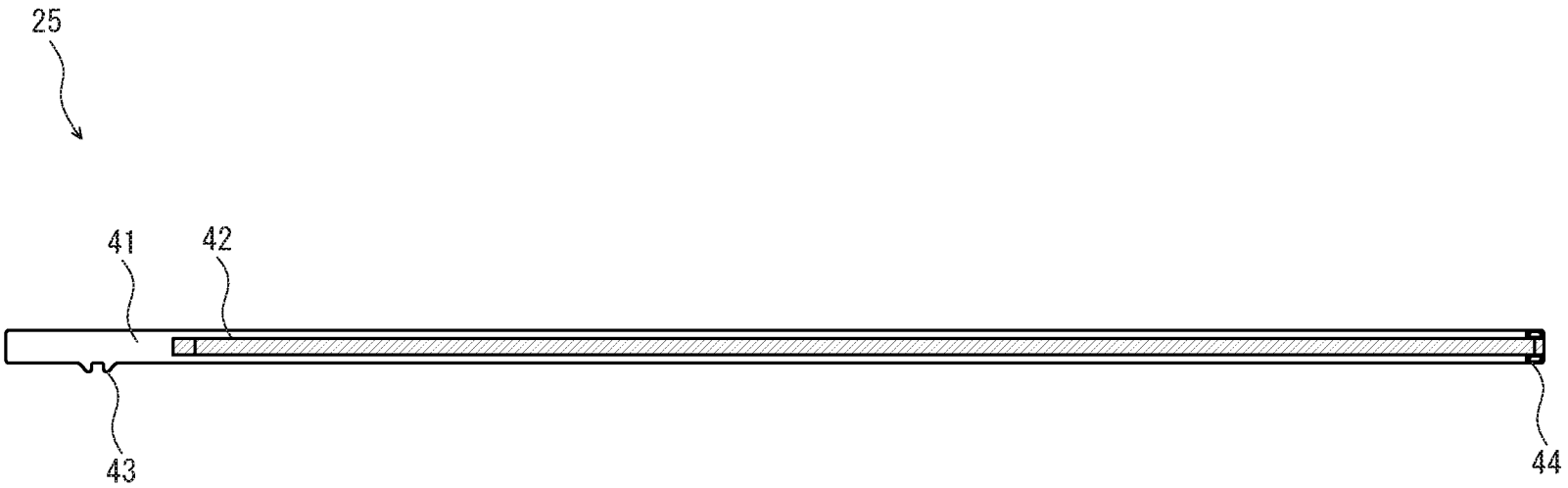
FIG. 10 is a side view showing the light guide body of the static eliminating device viewed from the right side in the color printer according to the embodiment of the present disclosure.
Figure 11:
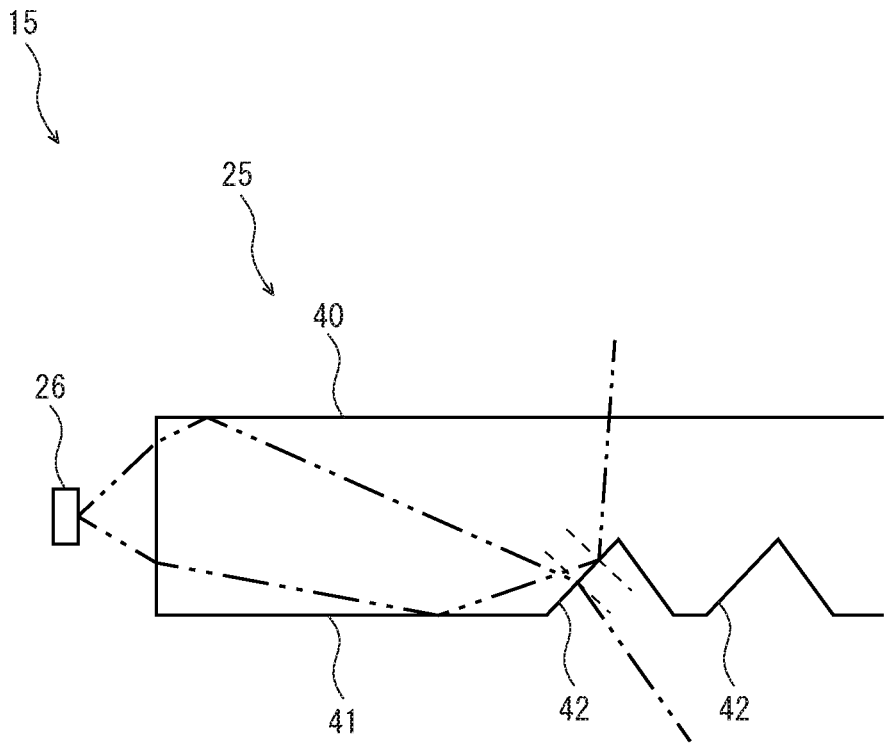
FIG. 11 is a sectional view schematically showing the static eliminating device, in a state emitting static eliminating light from an emission face and a reflection face, in the color printer according to the embodiment of the present disclosure.

At the reflection face 41 side of the light guide body 25, as shown in FIG. 8 and others, a plurality of reflection parts 42 are arranged in parallel at roughly regular intervals over the forward and backward directions of the light guide body 25. Each reflection part 42 is, for example, elongated in a cross direction of the forward and backward directions and formed in a V-formed sectional shape to act as a prism reflecting incident light from a front end of the light guide body 25 to the emission face 40 side and the reflection face 41 side. Light transmitted thorough the reflection part 42 of the light guide body 25 to the reflection face 41 side is used as pre-transfer static eliminating light to irradiate the photosensitive drum 11 at the downstream side from the light guide body 25 in the rotational direction of the intermediate transfer belt 5 (the other photosensitive drum 11 at the downstream side from one photosensitive drum 11 corresponding to this static eliminating device 15). Light reflected by the reflection part 42 of the light guide body 25 to the emission face 40 side is used as post-transfer static eliminating light to irradiate the photosensitive drum 11 at an upstream side from the light guide body 25 in the rotational direction of the intermediate transfer belt 5 (one photosensitive drum 11 corresponding to this static eliminating device 15).

Figure 12:
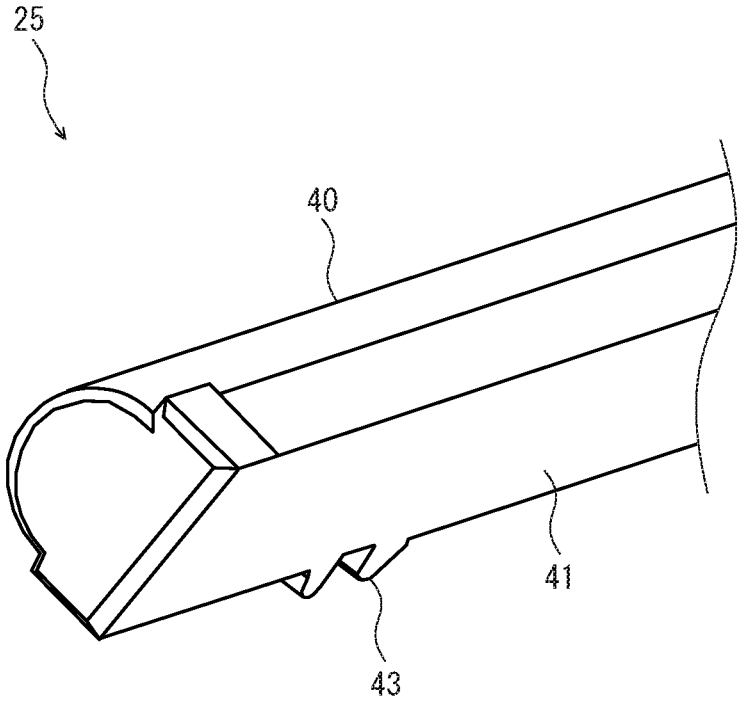
FIG. 12 is a perspective view showing a front part of the light guide body of the static eliminating device in the color printer according to the embodiment of the present disclosure.
Figure 13:
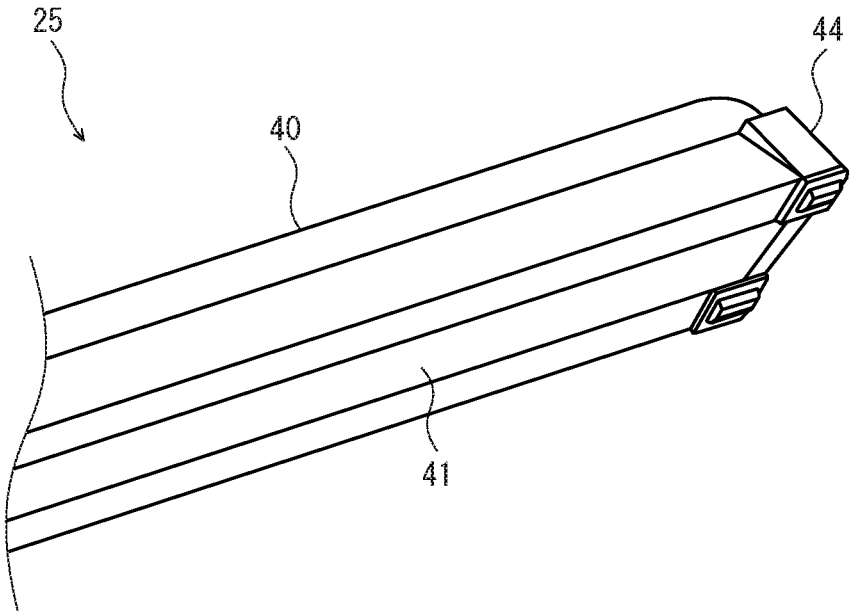
FIG. 13 is a perspective view showing a rear part of the light guide body of the static eliminating device in the color printer according to the embodiment of the present disclosure.

Moreover, in the front part of the light guide body 25, as shown in FIG. 12 and others, a first front positioning part 43 (an attachment part) positioning the light guide body 25 in the forward and backward directions is formed. In a rear end of the light guide body 25, as shown in FIG. 13 and others, a first rear positioning part 44 positioning the light guide body 25 in a direction other than the forward and backward directions is formed. The first front positioning part 43 is composed of, for example, two protrusions to interpose an edge of the first front positioning hole 33 of the front plate part 31 of the drum frame 30, and thereby, the light guide body 25 is positioned in the forward and backward directions. The first rear positioning part 44 is formed, for example, in a rectangular sectional shape to be fitted into the first rear positioning hole 35 of the rear plate part 32 of the drum frame 30, and thereby, the light guide body 25 is positioned in the direction other than the forward and backward directions.

The light source 26 of the static eliminating device 15 is arranged at the front side of the light guide body 25 and composed of LED or the like making static eliminating light incident on the front end of the light guide body 25.

Figure 14:
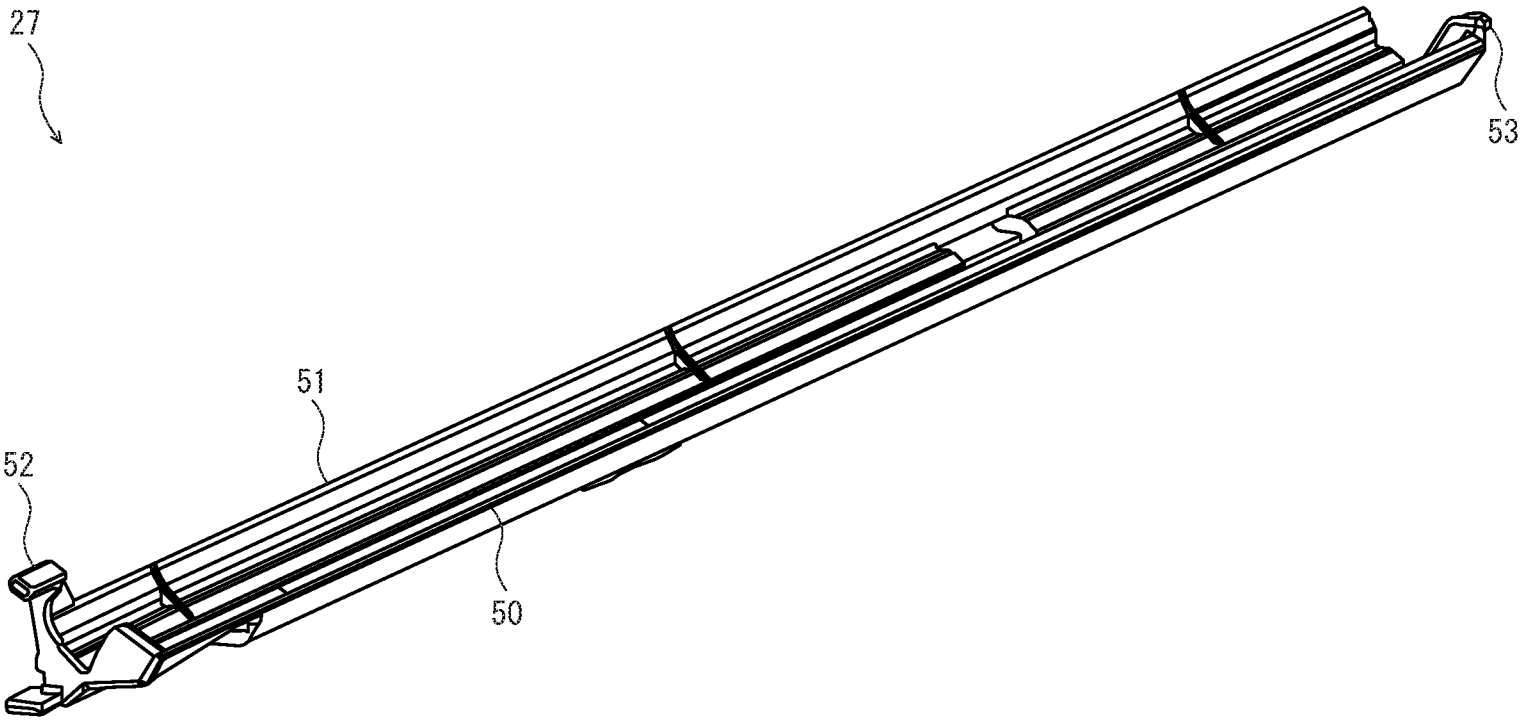
FIG. 14 is a perspective view showing a light shading member in the color printer according to the embodiment of the present disclosure.
Figure 15:
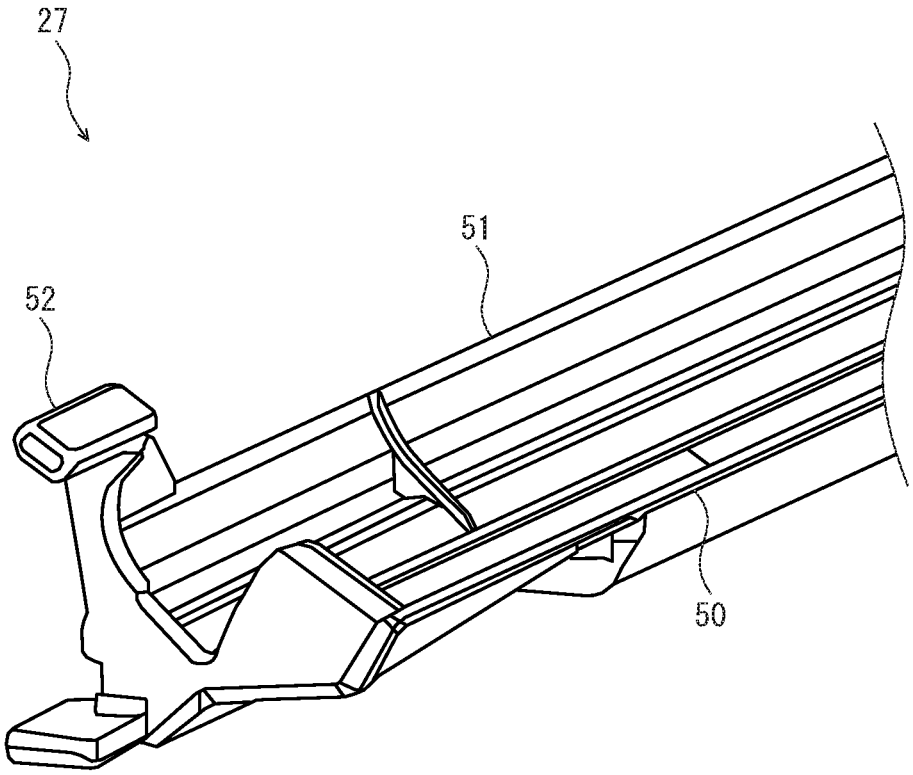
FIG. 15 is a perspective view showing a front part of the light shading member viewed from the front side in the color printer according to the embodiment of the present disclosure.
Figure 16:
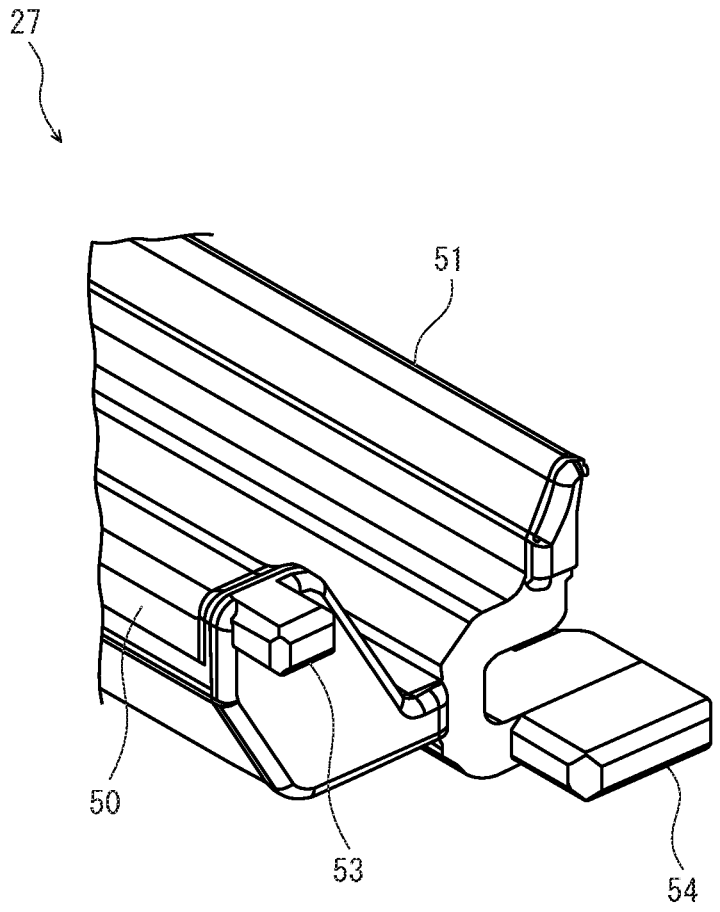
FIG. 16 is a perspective view showing a rear part of the light shading member viewed from the rear side in the color printer according to the embodiment of the present disclosure.
Figure 17:
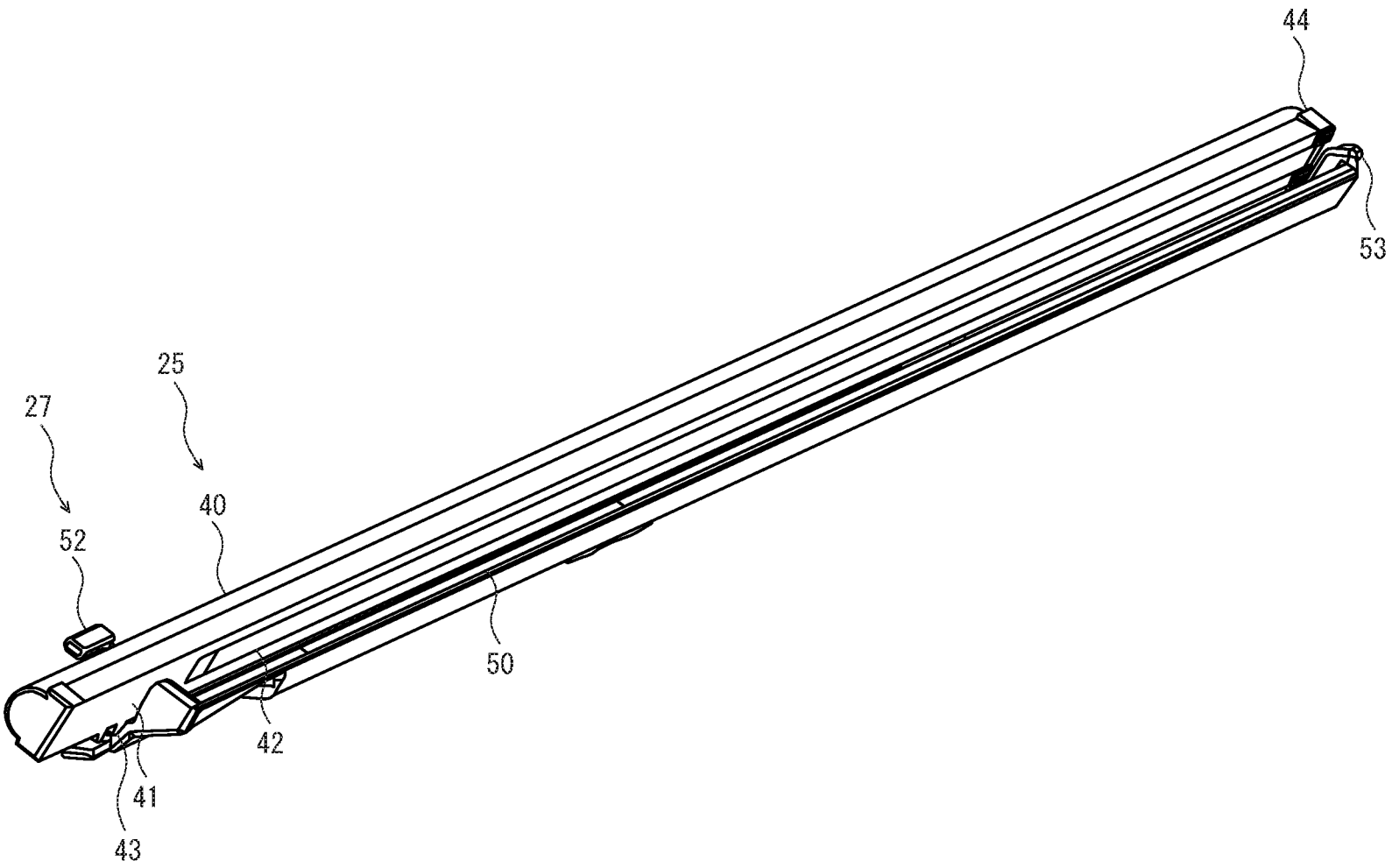
FIG. 17 is a perspective view showing the light shading member, to which the light guide body of the static eliminating device is attached, in the color printer according to the embodiment of the present disclosure.
Figure 18:
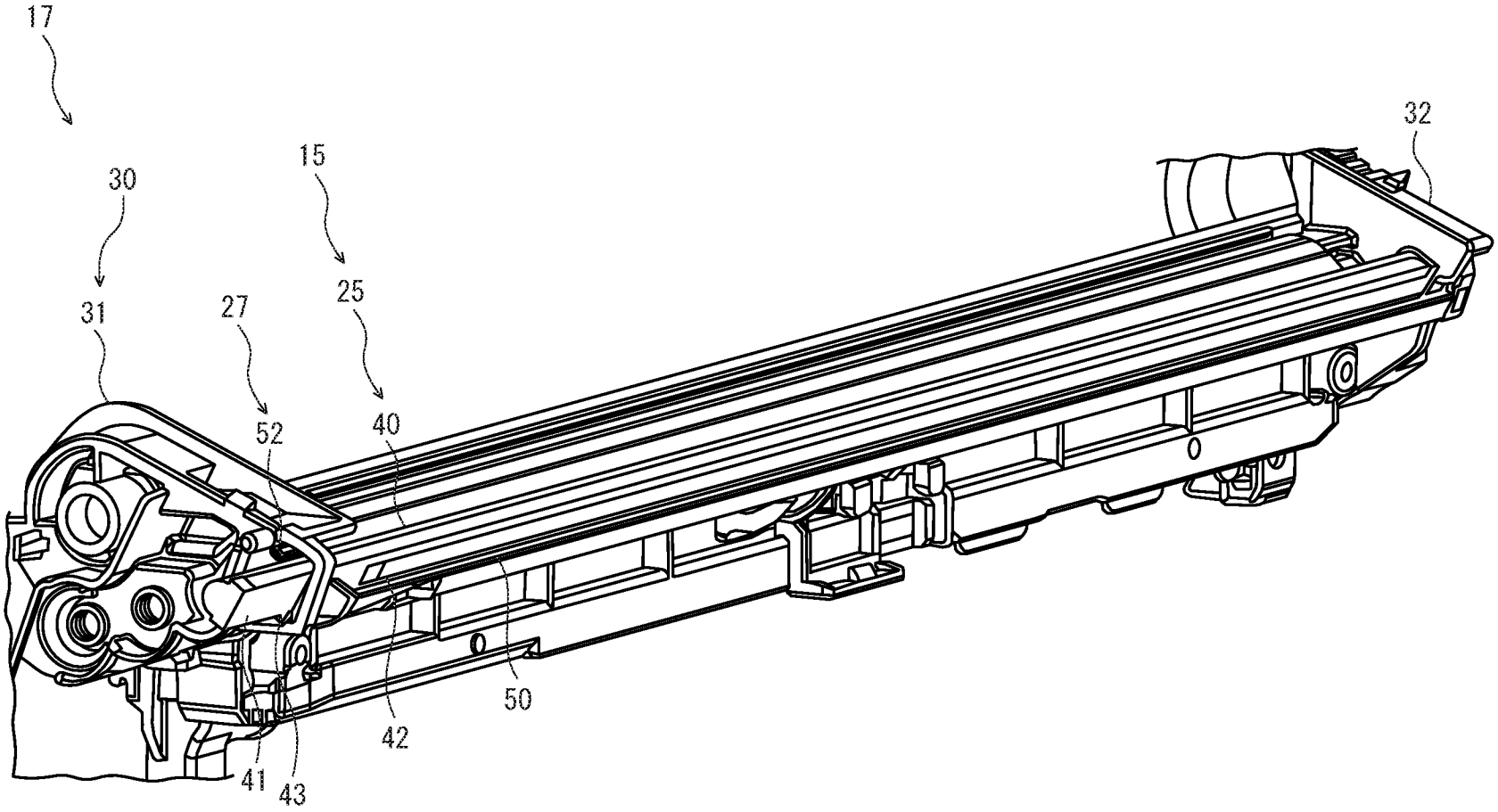
FIG. 18 is a perspective view showing the drum frame of the drum unit, to which the light shading member and the light guide body of the static eliminating device are attached, in the color printer according to the embodiment of the present disclosure.
Figure 19:
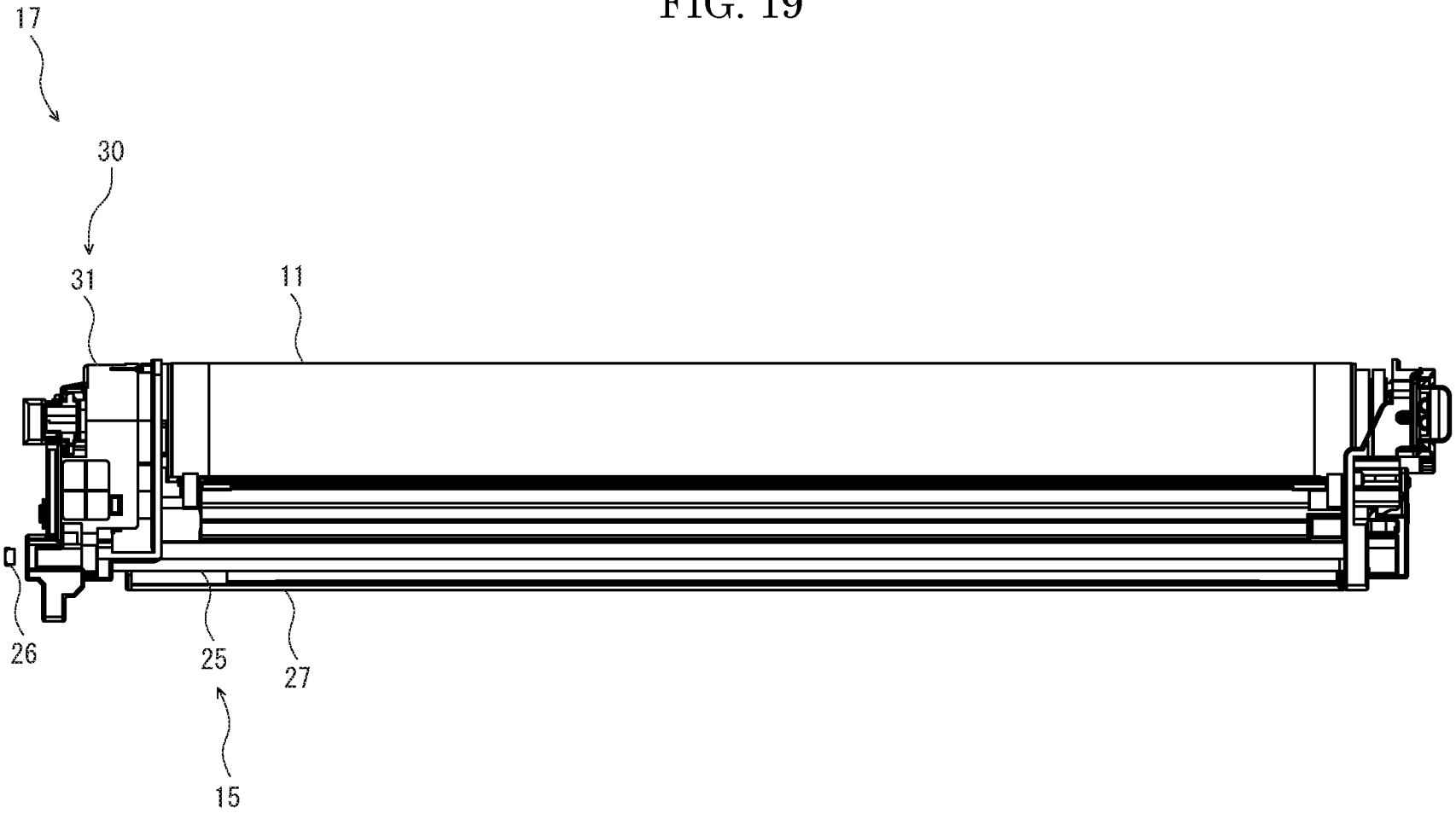
FIG. 19 is a plan view showing the drum unit in the color printer according to the embodiment of the present disclosure.
Figure 20:
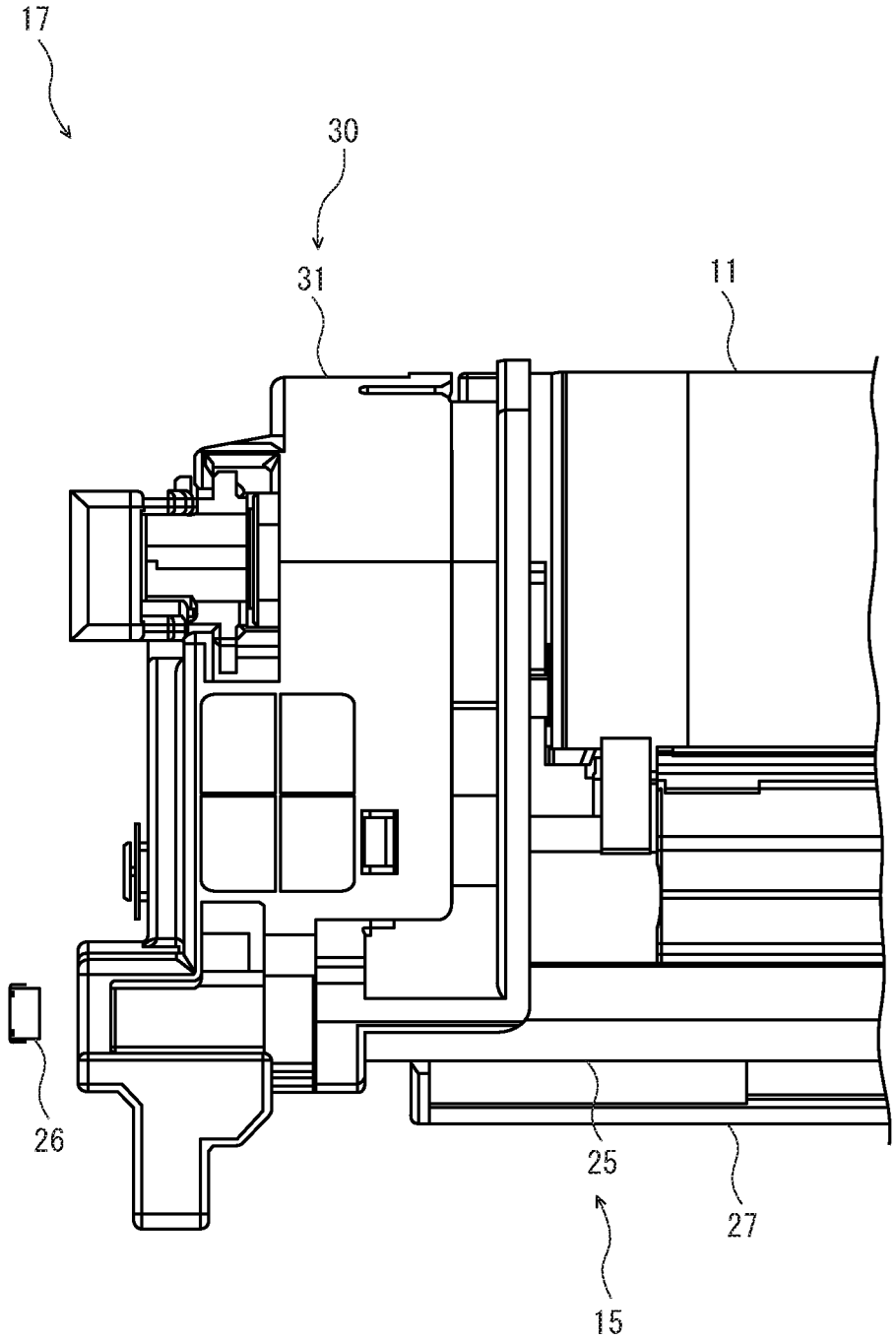
FIG. 20 is a plan view showing a front part of the drum unit in the color printer according to the embodiment of the present disclosure.
Figure 21:
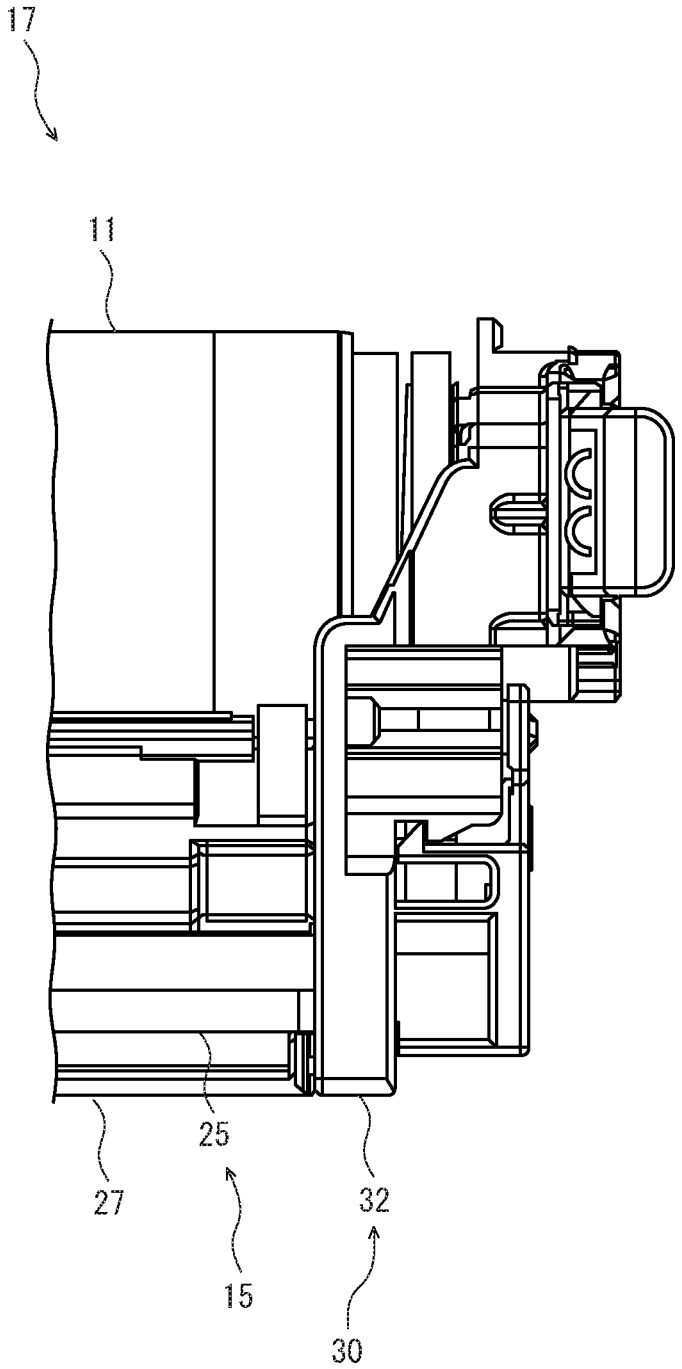
FIG. 21 is a plan view showing a rear part of the drum unit in the color printer according to the embodiment of the present disclosure.
Figure 22:
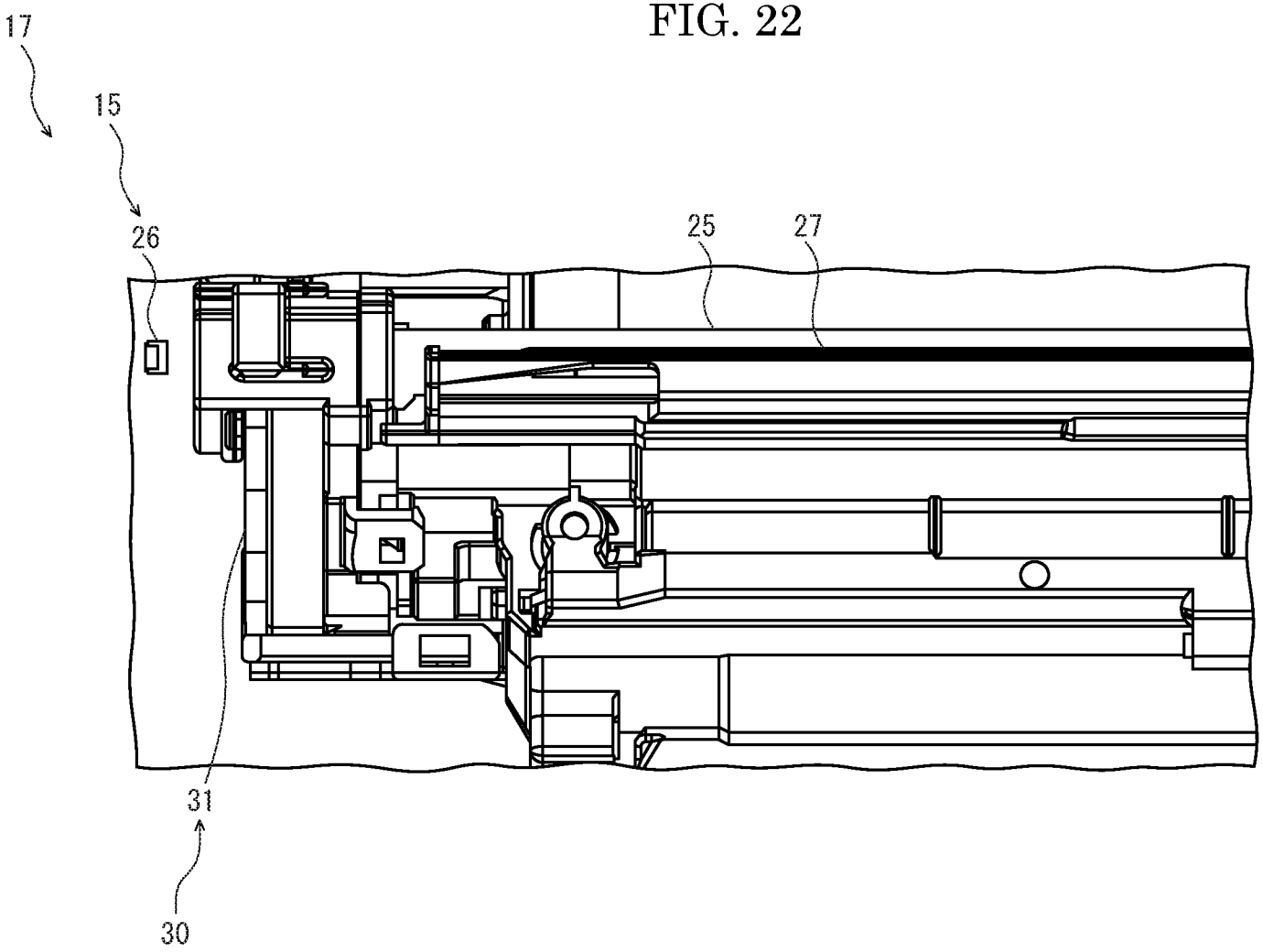
FIG. 22 is a side view showing the front part of the drum unit in the color printer according to the embodiment of the present disclosure.
Figure 23:
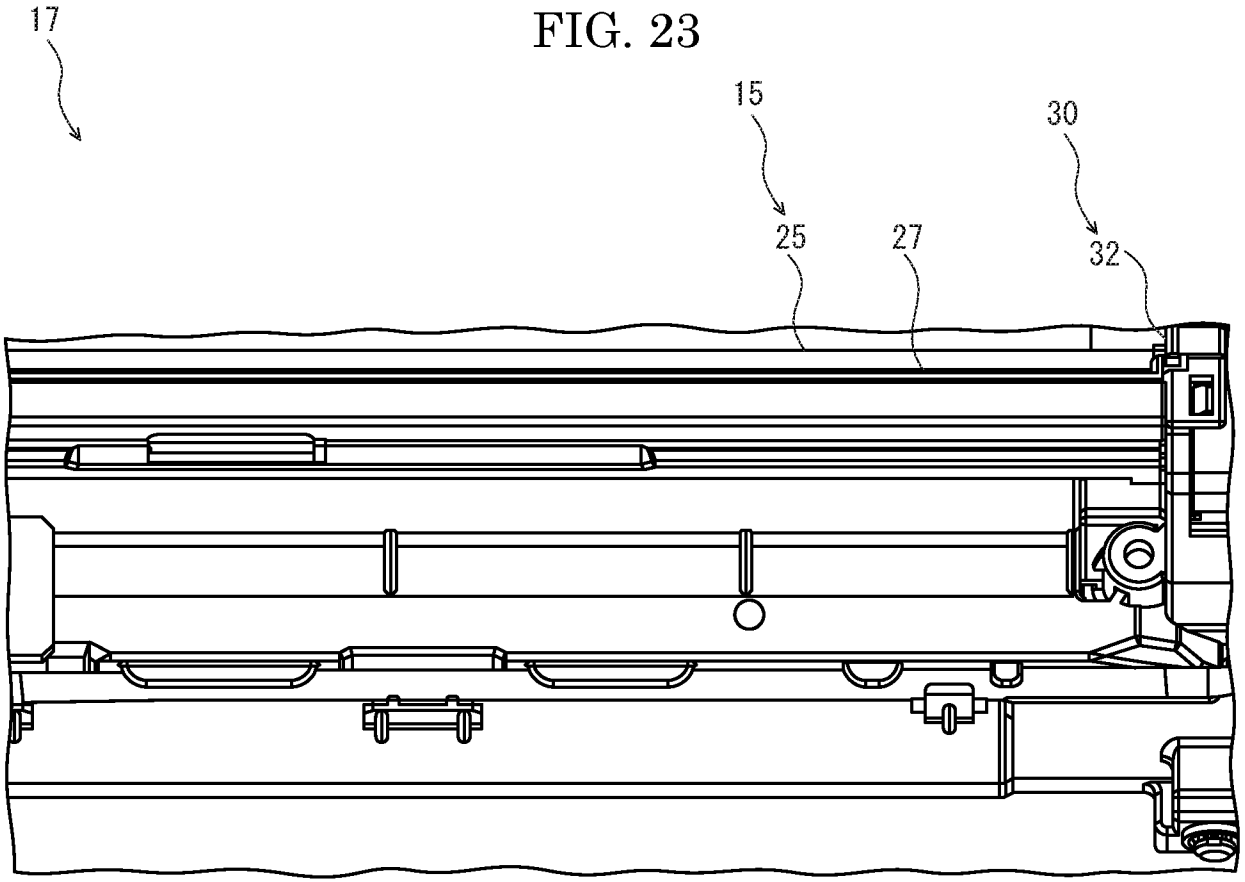
FIG. 23 is a side view showing the rear part of the drum unit in the color printer according to the embodiment of the present disclosure.

The light shading member 27 has, as shown in FIGS. 2-5 and 14-23, a shape elongated in the forward and backward directions, and its length is shorter than a length of the light guide body 25 and roughly equals to the distance between the front plate part 31 and the rear plate part 32 of the drum frame 30. Moreover, the light shading member 27 includes, as shown in FIGS. 14-16 and others, a first light shading part 50 covering the reflection face 41 from the right side and a second light shading part 51 covering the emission face 40 from the left side over the forward and backward directions of the light guide body 25. The light shading member 27 may have, for example, a roughly U-formed sectional shape covering the light guide body 25 from the lower side, or may be formed so as to fit the light guide body 25. Incidentally, the light shading member 27 may include any one of the first light shading part 50 and the second light shading part 51.

The first light shading part 50 is arranged between the photosensitive drum 11 at the downstream side from the light guide body 25 in the rotational direction of the intermediate transfer belt 5 and this light guide body 25 to adjust pre-transfer static eliminating light quantity from the light guide body 25 to the photosensitive drum 11 at the downstream side. The second light shading part 51 is arranged between the photosensitive drum 11 at the upstream side from the light guide body 25 in the rotational direction of the intermediate transfer belt 5 and this light guide body 25 to adjust post-transfer static eliminating light quantity from the light guide body 25 to the photosensitive drum 11 at the upstream side. Each of the first light shading part 50 and the second light shading part 51 may include, for example, a light shading filter (a light shading area) having a predetermined transmittance to adjust the static eliminating light quantity by making the static eliminating light from the light guide body 25 transmitted through this light shading filter, or may include a light shading wall having a predetermined height to adjust the static eliminating light quantity by blocking off the static eliminating light from the light guide body 25 to the photosensitive drum 11 by this light shading wall.

Moreover, the first light shading part 50 and/or the second light shading part 51 may be configured to have different light shading amounts depending on a position in the axial direction of the photosensitive drum 11 so that the static eliminating light quantity from the static eliminating device 15 to the photosensitive drum 11 becomes uniform in the axial direction of the photosensitive drum 11. Subsequently, the first light shading part 50 and/or the second light shading part 51 may vary the static eliminating light quantity by varying the light shading amount. For example, the first light shading part 50 and/or the second light shading part 51 may be configured to include the light shading filter (the light shading area) having different transmittances depending on the position in the axial direction of the photosensitive drum 11 and to vary the light shading amount by varying the transmittance. Alternatively, the first light shading part 50 and/or the second light shading part 51 may be configured to include the light shading wall having different heights depending on the position in the axial direction of the photosensitive drum 11 and to vary the light shading amount by varying the height of the light shading wall. Otherwise, the first light shading part 50 and/or the second light shading part 51 may be configured to include the light shading filter (the light shading area) having the predetermined transmittance and different widths (lengths in a cross direction of the axial direction) of the light shading area depending on the position in the axial direction of the photosensitive drum 11 and to vary the light shading amount by varying the width.

In a front end of the light shading member 27, as shown in FIG. 15, a second front positioning part 52 positioning the light shading member 27 is formed and, in a rear end of the light shading member 27, as shown in FIG. 16, second rear positioning parts 53 and 54 positioning the light shading member 27 are formed. The second front positioning part 52 has, for example, a shape protruded forwardly to be fitted into the second front positioning hole 34 of the front plate part 31 of the drum frame 30, and thereby, the front part of the light shading member 27 is positioned. The second rear positioning parts 53 and 54 have, for example, a shape protruded backwardly to be fitted into the second rear positioning holes 36 and 37 of the rear plate part 32 of the drum frame 30, and thereby, the rear part of the light shading member 27 is positioned.

According to the embodiment, as described above, the color printer 1 (the image forming apparatus) includes the annular intermediate transfer belt 5 (the transfer belt) rotating in a predetermined rotational direction, the plurality of photosensitive drums 11, the plurality of primary transferring parts 14, the plurality of static eliminating devices 15 (the static eliminating parts) and the plurality of cleaning devices (the cleaning parts). The photosensitive drums 11 are arranged along the rotational direction of the intermediate transfer belt 5. The primary transferring parts 14 transfer images formed on the photosensitive drums 11 to the intermediate transfer belt 5. The static eliminating devices 15 discharge electric potential by irradiating the photosensitive drums 11 with static eliminating light. The cleaning devices 16 remove toner remained on the photosensitive drums 11. The static eliminating device 15 is arranged between the primary transferring part 14 and the cleaning device 16, and includes the light guide body 25 elongated in the axial direction of the photosensitive drum 11 and the light source 26 arranged at a front end side (one end side) in a longitudinal direction of the light guide body 25. The static eliminating device 15 is configured so as to irradiate the upstream side and the downstream side from the light guide body 25 in the rotational direction of the intermediate transfer belt 5 with the static eliminating light. The color printer 1 further includes at least any one of a first light shading part 50 and a second light shading part 51. The first light shading part 50 is arranged between the photosensitive drum 11 at the downstream side from the light guide body 25 in the rotational direction of the intermediate transfer belt 5 and the light guide body 25 to adjust pre-transfer static eliminating light quantity from the light guide body 25 to the photosensitive drum 11 at the downstream side. The second light shading part 51 is arranged between the photosensitive drum 11 at the upstream side from the light guide body 25 in the rotational direction of the intermediate transfer belt 5 and the light guide body 25 to adjust post-transfer static eliminating light quantity from the light guide body 25 to the photosensitive drum 11 at the upstream side.

In accordance with such a configuration, by a simple configuration including the first light shading part 50 and/or the second light shading part 51 between the photosensitive 11 and the static eliminating device 15, it is possible to obtain desired pre-transfer static eliminating light quantity and/or post-transfer static eliminating light quantity on the basis of the static eliminating light from the light guide body 25. Therefore, it is unnecessary to closely control light quantity of incident light from the light source 26 and it is sufficient that the light source 26 makes incident light having light quantity more than the pre-transfer static eliminating light quantity and the post-transfer static eliminating light quantity. Moreover, it is possible to use the light guide body 25 including one reflection face 41, and accordingly, it is unnecessary to complicate the plurality of reflection parts 42 formed on the reflection face 41. Thereby, it is possible to restrain cost of the light guide body 25

In addition, in the embodiment, the first light shading part 50 is provided in the light shading member 27 as a separate body from the drum frame 30 used for attaching the photosensitive drum 11 at the upstream side from the light guide body 25 in the rotational direction of the intermediate transfer belt 5, and is attached to the drum frame 30. The second light shading part 51 is provided in the light shading member 27 as a separate body from the drum frame 30 used for attaching the photosensitive drum 11 at the upstream side from the light guide body 25 in the rotational direction of the intermediate transfer belt 5, and is attached to the drum frame 30.

Thereby, it is sufficient that the first light shading part 50 or the second light shading part 51 (the light shading member 27) is attached to a unit other than a unit (e.g. the photosensitive drum corresponding to yellow or the like) not requiring the first light shading part 50 or the second light shading part 51 or a unit (e.g. the photosensitive drum corresponding to black or the like) requiring non-attachment of the first light shading part 50 or the second light shading part 51. In addition, since the first light shading part 50 and the second light shading part 51 (the light shading member 27) are attachable/detachable members, it is possible to actualize a configuration simultaneously shading pre-transfer static eliminating light and post-transfer static eliminating light without complicating. Further, by preparing the light shading members 27 including the first light shading parts 50 or the second light shading parts 51 permitting static eliminating lights of various light quantities, in case of desiring to vary the pre-transfer static eliminating light quantity or the post-transfer static eliminating light quantity, it is sufficient to vary the light shading member 27, and therefore, it is possible to immediately deal varying of the static eliminating light quantity without varying the drum unit 17 and drum frame 30.

In addition, in the embodiment, the first light shading part 50 and/or the second light shading part 51 are/is configured to have different light shading amounts depending on the position in the axial direction of the photosensitive drum 11 so that static eliminating light quantity from the static eliminating device 15 to the photosensitive drum 11 becomes uniform in the axial direction of the photosensitive drum 11.

Thereby, in case where light quantity is varied depending on the position in the axial direction of the light guide body 25 of the static eliminating device 15, as light quantity is larger, light shading amount is set larger in the first light shading part 50 or the second light shading part 51 and, as light quantity is smaller, light shading amount is set smaller in the first light shading part 50 or the second light shading part 51. Accordingly, the static eliminating light quantity obtained via the first light shading part 50 or the second light shading part 51 can be uniformed in the axial direction. For example, in comparison with the static eliminating light emitted at a side (the front side) near the light source 26 in the light guide body 25, the static eliminating light emitted at a side (the rear side) far from the light source 26 may be weak. In such a case, the first light shading part 50 or the second light shading part 51 is set so as to have largest light shading amount at the side near the light source 26 and to have smaller light shading amount as a position is farther from the light source 26.

Incidentally, in the embodiment, the first light shading part 50 and/or the second light shading part 51 are/is configured, for example, to include the light shading filter (the light shading area) having different transmittances depending on the position in the axial direction of the photosensitive drum 11.

Thereby, the first light shading part 50 and/or the second light shading part 51 can set light shading amounts depending on the position in the axial direction by a simple configuration as the light shading filter. For example, the light shading filter included in the first light shading part 50 and/or the second light shading part 51 is configured so that smaller transmittance is set as the position depends on larger light shading amount and that larger transmittance is set as the position depends on smaller light shading amount.

Alternatively, in the embodiment, the first light shading part 50 and/or the second light shading part 51 are/is configured, for example, to include the light shading wall having different heights depending on the position in the axial direction of the photosensitive drum 11.

Thereby, the first light shading part 50 and/or the second light shading part 51 can set light shading amounts depending on the position in the axial direction by a simple configuration as the light shading wall. For example, the light shading wall included in the first light shading part 50 and/or the second light shading part 51 is configured so that lower height is set as the position depends on larger light shading amount and that higher height is set as the position depends on smaller light shading amount.

Otherwise, in the embodiment, the first light shading part 50 and/or the second light shading part 51 are/is configured, for example, to include the light shading filter (the light shading area) having a predetermined transmittance and different widths of the light shading depending on the position in the axial direction of the photosensitive drum 11.

Thereby, the first light shading part 50 and/or the second light shading part 51 can set light shading amounts depending on the position in the axial direction by a more simple configuration as the light shading filter having a predetermined transmittance. For example, the light shading filter included in the first light shading part 50 and/or the second light shading part 51 is configured so that narrower width is set as the position depends on larger light shading amount and that wider width is set as the position depends on smaller light shading amount.

Although, in the above-described embodiment, a configuration that the first light shading part 50 and the second light shading part 51 are provided in the light shading member 27 as the separate body from the drum frame 30 and attached to the drum frame 30 was described, the present disclosure is not restricted by this configuration. For example, in a different embodiment, the first light shading part 50 and the second light shading part 51 may be integrally provided with the drum frame 30 used for attaching the photosensitive drum 11 at the upstream side from the light guide body 25 in the rotational direction of the intermediate transfer belt 5. In such a case, without providing the light shading member 27 as the separate body from the drum frame 30, the first light shading part 50 and the second light shading part 51 are integrally formed with the drum frame 30. Thereby, it is possible to reduce the number of components and to restrain cost, while light shading accuracy can be excellently maintained with respect to the static eliminating light emitted from the light guide body 25 of the static eliminating device 15.

Alternatively, in a further different embodiment, in a configuration including the plurality of developing device 13 (the developing units) corresponding to the plurality of photosensitive drums 11, the first light shading part 50 adjusting the pre-transfer static eliminating light quantity is provided to the developing device 13 corresponding to the photosensitive drum 11 at the downstream side from the light guide body 25 in the rotational direction of the intermediate transfer belt 5, but not to the light shading member 27 and the drum frame 30. In such a case, the first light shading part 50 is integrally formed with a developing frame or the like composing the developing device 13. Incidentally, the static eliminating light emitted from the light guide body 25 of the static eliminating device 15 is scattered broader as the position is farther from the light guide body 25. By contrast, the first light shading part 50 shades the static eliminating light toward the photosensitive drum 11 at a position far from the light guide body 25. In a case where the first light shading part 50 is arranged at a side near the light guide body 25, if a position of the first light shading part 50 is varied, variation of light quantity of the static eliminating light irradiating the photosensitive drum 11 is increased. However, as described above, by a configuration arranging the first light shading part 50 at a position far from the light guide body 25 of the static eliminating device 15 where the static eliminating light is scattered, even if the position of the first light shading part 50 is varied, it is possible to restrain variation of light quantity of the static eliminating light irradiating the photosensitive drum 11 small.

Next, a configuration of the static eliminating device 15 in another embodiment will be described with reference to the drawings. Description of similar configuration to the static eliminating device 15 in the above-described embodiment is omitted.

Figure 24:
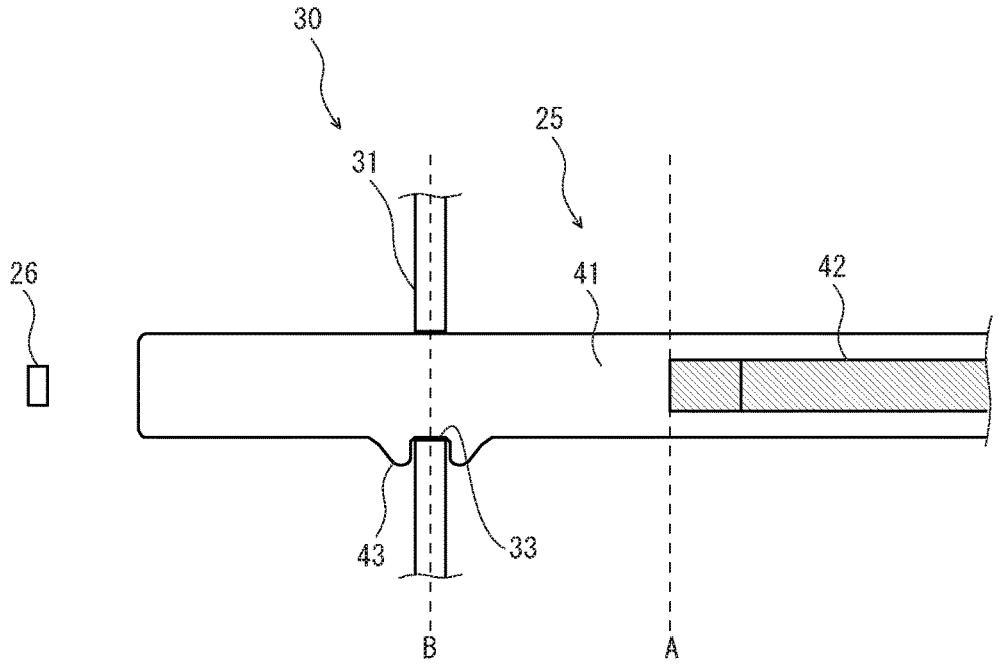
FIG. 24 is a side view showing a front part of the static eliminating device in the color printer according to another embodiment of the present disclosure.

In the static eliminating device 15 in another embodiment, the plurality of reflection parts 42 are arranged, as shown in FIG. 24, within a range at the rear side (the other end side) from a start position A spaced a predetermined distance from the front end (one end) in the longitudinal direction of the light guide body 25.

In the static eliminating device 15 in another embodiment, the first front positioning part 43 is located, as shown in FIG. 24, at an attachment position B between the front end (one end in the longitudinal direction) of the light guide body 25 and the start position A of the plurality of reflection parts 42 to act as a start point of thermal deformation due to thermal expansion, thermal contraction and others in the axial direction of the photosensitive drum 11 (the longitudinal direction of the light guide body 25). That is, when thermal expansion, thermal contraction and others occurs in the light guide body 25 in an attached state, the light guide body 25 is expanded, contracted or bent in the forward and backward directions (to one end side and the other end side in the longitudinal direction) with respect to the first front positioning part 43 as a reference. The attachment position B of the first front positioning part 43 is preferably set to a position spaced 10 mm or more from the front end (one end in the longitudinal direction) of the light guide body 25.

According to the embodiment, as described above, the static eliminating device 15 of the color printer 1 (the image forming apparatus) includes the light guide body 25 formed in a bar shape and the light source 26 arranged at a front end side (one end side in a longitudinal direction) of the light guide body 25. The light guide body 25 includes the plurality of reflection parts 42 and the first front positioning part 43 (the attachment part). The plurality of reflection parts 42 are arranged in parallel in the forward and backward directions (the longitudinal direction) within the range at the rear side (the other end side) from the start position A spaced a predetermined distance from the front end (one end in the longitudinal direction) of the light guide body 25. The first front positioning part 43 is arranged between the front end (one end in the longitudinal direction) and the start position A of the plurality of reflection parts 42 to act as the start point of thermal deformation in the forward and backward directions (the longitudinal direction).

In accordance with such a configuration, in the static eliminating device 15, even if incident light from the light source 26 toward the light guide body 25 is leaked from the first front positioning part 43, local light leak at the rear side from the first front positioning part 43 of the light guide body 25 does not occur. According to this, in the plurality of reflection parts 42 arranged at the rear side from the first front positioning part 43 of the light guide body 25, it is possible to restrain occurrence of non-uniformity of light quantity in the longitudinal direction (the axial direction of the photosensitive drum 11). Moreover, since the first front positioning part 43 positioning the light guide body 25 in the longitudinal direction is arranged at the attachment position B near the light source 26, the start point of thermal deformation due to thermal expansion, thermal contraction and others of the light guide body 25 becomes this attachment position B. Therefore, variation of a distance between the light source 26 and a front end face (one end face) of the light guide body 25 becomes small, and as a result, it is possible to restrain variation of light quantity of the static eliminating light obtained via the plurality of reflection parts 42. Thus, it is possible to actualize attachment mechanism of the light guide body 25 without causing non-uniformity of light quantity and variation of light quantity.

Moreover, in another embodiment, the light guide body 25 of the static eliminating device 15 is provided with the first front positioning part 43 (the attachment part) at the attachment position B spaced 10 mm or more from the front end (one end in the longitudinal direction).

Thereby, since the first front positioning part 43 is arranged at a position spaced an appropriate distance as 10 mm or more from the front end face (one end face) of the light guide body 25, it is possible to significantly reduce light leak from the light guide body 25. Therefore, it is possible not only to efficiently utilize light emitted from the light source 26 as static eliminating light, but also to prevent failure, such as image quality degradation due to flare light.

Incidentally, in the color printer 1, the cleaning unit 10 is arranged at a most upstream side from the plurality of photosensitive drums 11 in the rotational direction of the intermediate transfer belt 50. Accordingly, at the photosensitive drum 11 at the most upstream side among the plurality of photosensitive drums 11, the cleaned intermediate transfer belt 50 arrives, and then, there is no remained toner on the intermediate transfer belt 50. Therefore, since primary transferring efficiency at the photosensitive drum 11 at the most upstream side is high and require no light source of pre-transfer static eliminating light, the static eliminating device 15 and the light shading member 27 may not be provided.

Although the embodiments was described about a case applying the configuration of the present disclosure to the color printer 1, in another different embodiment, the configuration of the present disclosure may be applied to another image forming apparatus including the plurality of photosensitive drums, such as a copying machine, a facsimile and a multifunction peripheral.

Further, the above-description of the embodiments was described about one example of the static eliminating device according to the present disclosure and the image forming apparatus including this. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A static eliminating device comprising:

a light guide body formed in a bar shape and attached to a drum frame; and a light source arranged at one end side in a longitudinal direction of the light guide body, wherein the light guide body includes:

a plurality of reflection parts arranged in parallel in the longitudinal direction within a range at the other end side from a start position spaced a predetermined distance from one end in the longitudinal direction; and an attachment part formed integrally with the light guide body between one end in the longitudinal direction and the start position to act as a start point of thermal deformation in the longitudinal direction, the attachment part is composed of two protrusions arranged in parallel in the longitudinal direction to interpose an edge of one positioning hole provided in the drum frame at the one end side in the longitudinal direction, the light guide body is provided with the attachment part at a position spaced 10 mm or more from one end in the longitudinal direction, the light guide body has a positioning part formed in a rectangular sectional shape at the other end in the longitudinal direction, the positioning part is fitted into an other positioning hole provided in the drum frame at the other end side in the longitudinal direction, and the two protrusions of the attachment part position the light guide body in the longitudinal direction by interposing the edge of the one positioning hole at the one end side in the longitudinal direction, and the positioning part positions the light guide body in directions other than the longitudinal direction by being fitted into the other positioning hole at the other end side in the longitudinal direction.

2. The static eliminating device according to claim 1, wherein a front part of the light guide body is inserted into the one positioning hole opened in a front plate part of the drum frame at the one end side in the longitudinal direction, and the attachment part is formed in the front part of the light guide body.

3. An image forming apparatus comprising:

the static eliminating device according to claim 1.

4. An image forming apparatus comprising:

the static eliminating device according to claim 2.

* * * * *